US011006731B2

(12) United States Patent
Dunton et al.

(10) Patent No.: US 11,006,731 B2
(45) Date of Patent: May 18, 2021

(54) REFILLABLE COSMETIC COMPACT

(71) Applicant: HCP Packaging USA, Inc., Shelton, CT (US)

(72) Inventors: David P. Dunton, Stratford, CT (US); Stephen G. Dudienski, Ansonia, CT (US)

(73) Assignee: HCP Packaging USA, Inc., Shelton, CT (US)

( * ) Notice: Subject to any disclaimer, the term of this patent is extended or adjusted under 35 U.S.C. 154(b) by 250 days.

(21) Appl. No.: 16/368,298

(22) Filed: Mar. 28, 2019

(65) Prior Publication Data

US 2020/0305577 A1 Oct. 1, 2020

(51) Int. Cl.

| | |
|---|---|
| ***A45D 40/22*** | (2006.01) |
| ***A45D 33/00*** | (2006.01) |
| ***A45D 42/00*** | (2006.01) |

(52) U.S. Cl.

CPC ..... *A45D 40/22* (2013.01); *A45D 33/006* (2013.01); *A45D 42/00* (2013.01)

(58) Field of Classification Search

CPC ..... A45D 40/22; A45D 33/006; A45D 42/00; A45D 33/008

See application file for complete search history.

(56) References Cited

U.S. PATENT DOCUMENTS

| | | | |
|---|---|---|---|
| 1,642,611 | A | 9/1927 | Kendall |
| 5,323,794 | A | 6/1994 | Favre |
| 5,896,866 | A | 4/1999 | Quennessen |
| 5,909,738 | A | 6/1999 | Quennessen |
| 6,076,679 | A | 6/2000 | Yuhara et al. |

(Continued)

FOREIGN PATENT DOCUMENTS

| | | | |
|---|---|---|---|
| JP | 6124689 | B2 | 5/2017 |
| WO | WO8600600 | A1 | 1/1986 |

OTHER PUBLICATIONS

United States Patent & Trademark Office, International Search Report and Written Opinion,PCT/ISA/220, Application No. PCT/US2019/024644, dated Jun. 14, 2019, U.S. Patent & Trademark Office, Alexandria, VA.

*Primary Examiner* — James N Smalley
(74) *Attorney, Agent, or Firm* — Thomas P. O'Connell; O'Connell Law Firm

(57) ABSTRACT

A refillable cosmetic compact with a product base insert repositionable in relation to a base structure between an engaged configuration and a disengaged configuration. An actuation opening through the base structure permits a pressing of a release button of the product base insert to induce the product base insert from the engaged to the disengaged configuration. Resiliently deflectable catch members project longitudinally from either or both of the base structure and the product base insert. Converging deflection surfaces engage the catch members as the product base insert is repositioned from the disengaged configuration to the engaged configuration to deflect the catch members laterally inwardly to retain a cosmetic pan and to permit a deflection of the catch members laterally outwardly as the product base insert is repositioned from the engaged configuration to the disengaged configuration to release or receive a cosmetic pan.

41 Claims, 12 Drawing Sheets

(56) References Cited

U.S. PATENT DOCUMENTS

| | | | | | |
|---|---|---|---|---|---|
| 6,129,089 | A * | 10/2000 | Yuhara | A45C 13/008 132/300 |
| 6,138,686 | A * | 10/2000 | Yuhara | A45C 13/008 132/293 |
| RE38,398 | E * | 1/2004 | Gueret | A45D 33/006 132/299 |
| 9,210,984 | B2 * | 12/2015 | Byeon | A45D 33/006 |
| 9,237,791 | B2 | 1/2016 | Hirst | |
| 9,717,316 | B2 | 8/2017 | Attard-Kingswell et al. | |
| 2007/0029226 | A1 | 2/2007 | Yuhara et al. | |
| 2008/0011320 | A1 | 1/2008 | Bouix et al. | |
| 2011/0048442 | A1 | 3/2011 | Pires et al. | |
| 2012/0305606 | A1 | 12/2012 | Lee et al. | |
| 2014/0231304 | A1 | 8/2014 | Lee | |
| 2014/0283870 | A1 | 9/2014 | Byeon | |
| 2016/0015149 | A1 | 1/2016 | Kim et al. | |
| 2016/0235184 | A1 * | 8/2016 | Lee | B65D 43/02 |
| 2017/0095055 | A1 | 4/2017 | Chung | |
| 2018/0370696 | A1 * | 12/2018 | Lee | B65D 51/18 |
| 2019/0000210 | A1 * | 1/2019 | Kim | B65D 77/04 |
| 2019/0021468 | A1 * | 1/2019 | Zhan | A45D 33/003 |

* cited by examiner

REFILLABLE COSMETIC COMPACT

FIELD OF THE INVENTION

The present invention relates generally to cosmetic product packaging. More particularly, disclosed herein is a cosmetic compact for solid, semi-solid, and potentially other cosmetics with an engaged configuration that permits a cosmetic pan to be securely retained against inadvertent displacement and a disengaged configuration that permits a cosmetic pan to be removed from and inserted into the cosmetic compact quickly and easily.

BACKGROUND OF THE INVENTION

Compacts for solid or semi-solid cosmetic products typically have a base structure and a cover. One or more inner volumes or cavities are disposed in the base structure for receiving and retaining a volume of cosmetic. The solid or semi-solid cosmetic product may, by way of example and not limitation, be pressed or caste powder, semi-solid paste, or a cosmetic cake. Such materials could, again by way of illustration, could comprise blush powder, skin foundation cosmetic, lip cosmetic, eye shadow, or another cosmetic product. The cosmetic product is often disposed in a shallow plastic or metal pan to be retained in the inner volume of the base structure.

It is important that the cosmetic product be securely retained in the cavity of the cosmetic compact, particularly since the compact is likely to be subjected to jostling and impacts not only during use but also while it is transported, such as within a pocket, a purse, or a travel bag. It is likewise important that cosmetic compacts be efficiently arranged so that available space is maximized. Furthermore, in the competitive field of cosmetic packaging, it is a common goal to develop packaging demonstrating increased efficiencies in manufacturing and material requirements. Perceived elegance and luxury in operation are also long-recognized goals in the cosmetics industry.

Meanwhile, there is a need to permit the cosmetic pan to be selectively removed from its position within the cavity of the cosmetic compact. For instance, when a volume of cosmetic within a pan is nearly or completely gone, it is desirable to be able to replace the pan within the compact. In other circumstances, a user may wish to switch the cosmetic pan to one containing a different color or type of cosmetic.

There have been multiple attempts to provide a cosmetic compact capable of securely retaining a cosmetic pan for usage and transport while permitting the selective removal and replacement thereof. In certain prior art cosmetic compacts, a user must attempt to pry the cosmetic pan from its position within the compact in a practice prone to messiness, inadvertent dropping, and general inconvenience. In other cosmetic compacts, such as in that disclosed by International Publication No. WO86/00600 of Strnad, a magnet is required for releasably retaining a cosmetic pan, and the cosmetic pan must include ferrous metal. Still further, to accomplish the somewhat competing goals of achieving secure retention while permitting ready removal and replacement of cosmetic pans, many cosmetic compacts of the prior art have been markedly complex in structure and operation.

The present inventors have thus recognized the need for a cosmetic compact of efficient construction and elegant operation that is capable of securely retaining a volume of cosmetic material while permitting the cosmetic material to be selectively removed from the cosmetic compact in a convenient manner.

SUMMARY OF THE INVENTION

With a knowledge of the needs in the art relating to cosmetic compacts, the present inventors set forth with the broadly stated object of providing a cosmetic compact with an engaged or retention configuration wherein a volume of cosmetic can be retained against inadvertent displacement and a disengaged or release configuration that permits cosmetic material to be inserted into and removed from the cosmetic compact.

A further object of the invention is to provide a cosmetic compact that can be selectively actuated from the engaged configuration to the disengaged configuration quickly and conveniently.

An additional object of the invention is to provide a cosmetic compact that is efficient and elegant in manufacture and use.

These and further objects, advantages, and details of the present invention will become obvious not only to one who reviews the present specification and drawings but also to those who have an opportunity to make use of an embodiment of the cosmetic compact disclosed herein. Although the accomplishment of each of the foregoing objects in a single embodiment of the invention may be possible and indeed preferred, not all embodiments will seek or need to accomplish each and every potential advantage and function. Nonetheless, all such embodiments should be considered within the scope of the present invention.

In carrying forth the foregoing objects, one embodiment of the present invention comprises a refillable cosmetic compact with an engaged configuration that permits a cosmetic product to be retained by the cosmetic compact and a disengaged configuration that permits the cosmetic product to be inserted into and removed from the cosmetic compact. The cosmetic product could, for example, comprise a volume of cosmetic product retained in a cosmetic product pan. The cosmetic compact has a product base insert with a floor and a sidewall that define a cavity or inner volume for receiving the cosmetic product, and the cosmetic compact has a base structure with a floor, an outer wall structure, and an inner wall structure wherein the inner wall structure defines an actuation opening through the base structure. The actuation opening is open to the product base insert. The product base insert is repositionable in relation to the base structure between an engaged configuration wherein the cosmetic product can be retained by the cosmetic compact and a disengaged configuration wherein the cosmetic product can be released from or inserted into the cosmetic compact.

In certain embodiments of the refillable cosmetic compact, the base structure retains a plurality of resiliently deflectable catch members, and the product base insert has a corresponding plurality of apertures for receiving the catch members. A converging surface is retained by the product base insert in relation to each aperture. Each converging surface has a sloped portion disposed at a distal portion of the aperture. The converging surfaces are positioned to engage distal portions of the catch members as the product base insert is repositioned from the disengaged configuration to the engaged configuration to induce a deflection of the catch members laterally inwardly and to permit a deflection of the catch members laterally outwardly as the product base insert is repositioned from the engaged configuration to the disengaged configuration. Under such constructions, the catch members grip and retain the cosmetic product when the product base insert is in the engaged configuration, and the catch members can release or permit the insertion of the cosmetic product when the product base insert is in the disengaged configuration.

The refillable cosmetic compact can be considered to have a longitudinal direction, and the catch members can project from the floor of the base structure generally in the longitudinal direction. Catch members can be retained by the base structure in opposition, such as in opposed pairs where the cosmetic compact is rectangular or along a rounded shape where the cosmetic compact is rounded.

In embodiments of the compact, the converging surfaces slope from being spaced a distance greater than a distance between outwardly facing surfaces of the catch members when the catch members are in a non-deflected configuration to being spaced a distance less than the distance between the outwardly facing surfaces of the catch members when the catch members are in a non-deflected configuration. With this, the converging surfaces deflect the catch members inwardly when pressed to the engaged configuration, and the converging surfaces allow the catch members to deflect outwardly when adjusted to the disengaged configuration.

In practices of the invention, retaining formations can be disposed at the distal ends of the catch members. For instance, the retaining formations could comprise inward protuberances with proximal shelf portions for engaging the rim of a cosmetic product pan. With or without such retaining formations, the catch members, when in a non-deflected configuration, can have a lateral distance between them sufficient to bound the inner volume to permit the insertion and removal of the cosmetic product, such as the cosmetic product pan.

The apertures in the product base insert can, in certain embodiments, have an L-shape with a base of the L-shape comprising a space within the floor of the product base insert and a bottom of the sidewall of the product base insert and an upstanding portion of the L-shape comprising an opening in the sidewall of the product base insert. With that, the catch members are interposed between sections of the sidewall of the product base insert.

It is further disclosed that the cosmetic compact can include a latching mechanism for adjustably retaining the product base insert in the engaged configuration and, alternatively, in the disengaged configuration. The latching mechanism can, for example, be a snap-fit latching mechanism formed by at least one ridge retained by the product base insert and at least one ridge retained by the base structure disposed in opposition to the at least one ridge retained by the product base insert in an interference relationship.

In particular manifestations of the cosmetic compact, the product base insert has a release button that is centrally disposed to project in a longitudinal direction into the actuation opening in the base structure. With that, the release button can be pressed to induce the product base insert from the engaged configuration to the disengaged configuration.

The release button can have a cross-sectional shape matching a cross-sectional shape of the actuation opening in the base structure. By way of example and not limitation, the release button and the actuation opening can have round cross sections. Other shapes are readily possible.

The refillable cosmetic compact can include a cover with a closed configuration wherein the inner volume of the cosmetic compact is enclosed and an open configuration wherein the inner volume of the cosmetic compact is open. The cover could be engaged in any effective manner, including by a coupling to the base structure by a hinge.

The shape of the refillable cosmetic compact and the retained cosmetic product can vary within the scope of the invention. In certain practices of the invention, for example, the refillable cosmetic compact can be rectangular. By way of example and not limitation, the refillable cosmetic compact could be square. In other practices, the refillable cosmetic compact can be rounded. As used herein, the concept of being rounded is intended to include circular, oval, and other rounded shapes. In such rounded configurations, the cosmetic compact can be considered to have a longitudinal centerline, and the converging surfaces can have sloped portions that converge toward the longitudinal centerline. Moreover, the catch members can then be disposed along a rounded, such as a circular, shape.

Alternatively characterized, embodiments of the cosmetic compact again have an engaged configuration that permits a cosmetic product to be retained by the cosmetic compact and a disengaged configuration that permits the cosmetic product to be removed from the cosmetic compact. The cosmetic compact has a base structure with a floor, an outer wall structure, and a plurality of resiliently deflectable catch members. A product base insert has a floor and a sidewall wherein the floor and the sidewall of the product base insert define a cavity or inner volume for receiving the cosmetic product, such as a volume of cosmetic in a cosmetic pan. The product base insert is repositionable in relation to the base structure between an engaged configuration wherein the cosmetic product can be retained by the cosmetic compact and a disengaged configuration wherein the cosmetic product can be released from or inserted into the cosmetic compact. A plurality of apertures are disposed in the product base insert for receiving the product pan catch members, and a converging surface is retained by the product base insert in relation to each aperture. Each converging surface has a sloped portion disposed at a distal portion of the aperture. The converging surfaces are positioned to engage distal portions of the catch members as the product base insert is repositioned from the disengaged configuration to the engaged configuration to induce a deflection of the catch members laterally inwardly and to permit a deflection of the catch members laterally outwardly as the product base insert is repositioned from the engaged configuration to the disengaged configuration.

In such embodiments, the base structure can further comprise an inner wall structure that defines an actuation opening through the base structure. The actuation opening is open to the product base insert. Further, the product base insert can include a release button that is centrally disposed to project into the actuation opening in the base structure. With that, the release button can be pressed to induce the product base insert from the engaged configuration to the disengaged configuration.

In a further manifestation of the invention, the refillable cosmetic compact again has an engaged configuration that permits a cosmetic product to be retained by the cosmetic compact and a disengaged configuration that permits the cosmetic product to be inserted into and removed from the cosmetic compact. A base structure has a floor and an outer wall structure, and a product base insert has a floor, a sidewall, and a plurality of resiliently deflectable catch members. The floor and the sidewall of the product base insert define a cavity for receiving the cosmetic product. The product base insert is repositionable in relation to the base structure between an engaged configuration wherein the cosmetic product can be retained by the cosmetic compact and a disengaged configuration wherein the cosmetic product can be released from or inserted into the cosmetic compact. At least one deflection surface is retained by the base structure. The at least one deflection surface could be a continuous surface or plural individual deflection surfaces. The at least one deflection surface is positioned to engage each catch member as the product base insert is repositioned from the disengaged configuration to the engaged configuration to induce a deflection of the catch members laterally inwardly and to permit a deflection of the catch members laterally outwardly as the product base insert is repositioned from the engaged configuration to the disengaged configuration.

In practices of the invention, the refillable cosmetic compact can be considered to have a longitudinal direction, and the catch members can project from the floor of the product base insert generally in the longitudinal direction. The product pan catch members could be retained by the product base insert in opposition, such as by being disposed in opposed pairs. The at least one deflection surface can slope from being spaced a distance greater than a distance between outwardly facing surfaces of the catch members when the catch members are in a non-deflected configuration to being spaced a distance less than the distance between the outwardly facing surfaces of the catch members when the catch members are in a non-deflected configuration. The at least one deflection surface could be a wedge, a sloped surface, a protuberance, or any other surface or surfaces positioned to deflect the catch members inwardly.

One will appreciate that the foregoing discussion broadly outlines the more important goals and features of the invention to enable a better understanding of the detailed description that follows and to instill a better appreciation of the inventors' contribution to the art. Before any particular embodiment or aspect thereof is explained in detail, it must be made clear that the following details of construction and illustrations of inventive concepts are mere examples of the many possible manifestations of the invention.

DETAILED DESCRIPTION OF PREFERRED EMBODIMENTS

Figure 1:
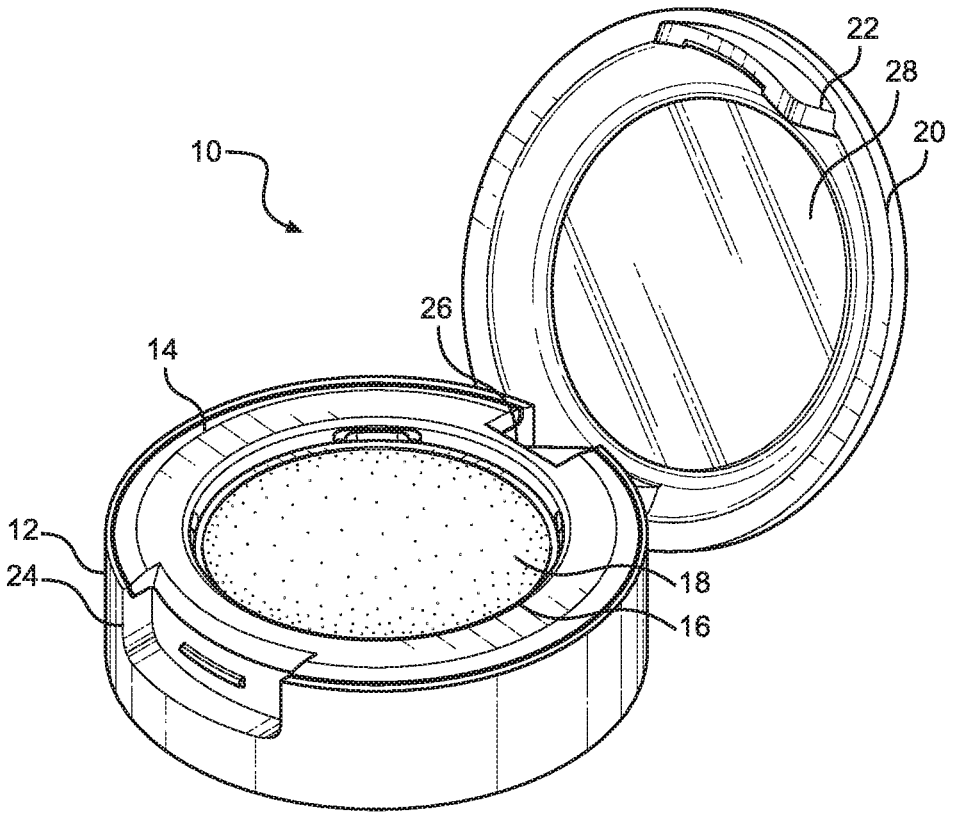
FIG. 1 is a perspective view of a refillable cosmetic compact according to the present invention retaining a cosmetic pan filled with cosmetic material.
Figure 2:
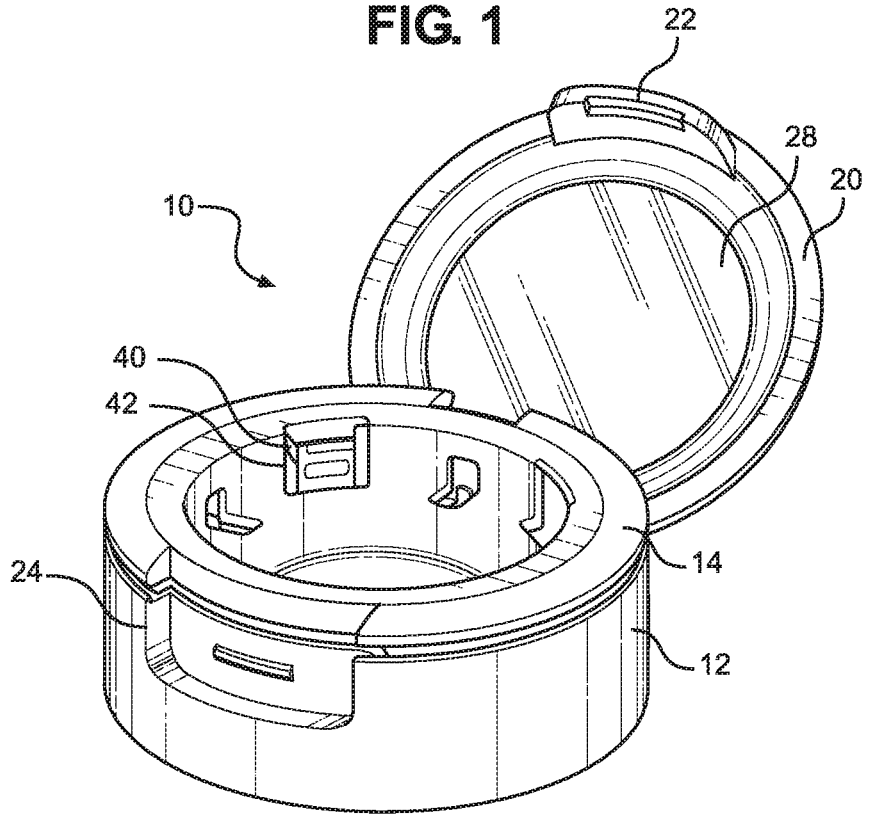
FIG. 2 is a perspective view of the refillable cosmetic compact with the cosmetic pan removed.
Figure 3:
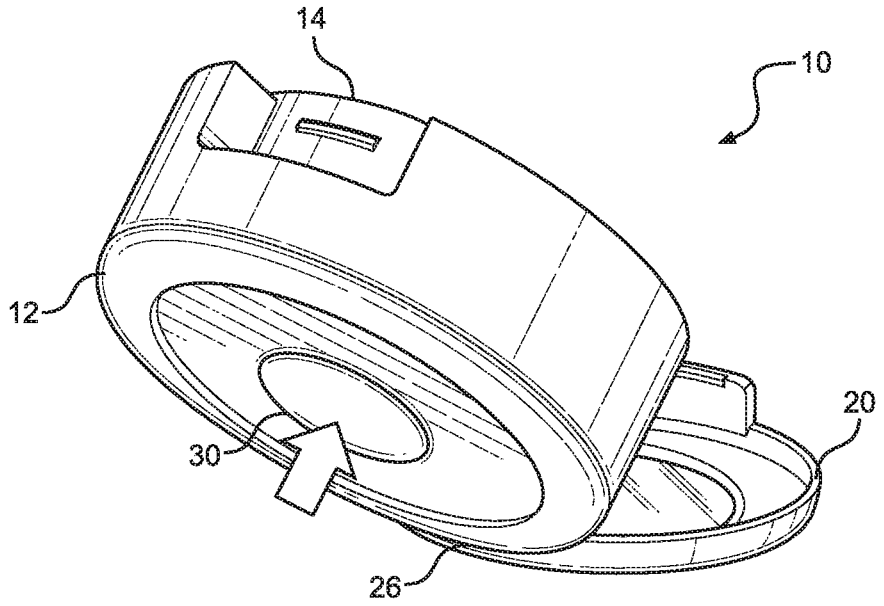
FIG. 3 is a perspective view of the refillable cosmetic compact in a partially overturned position.
Figure 4:
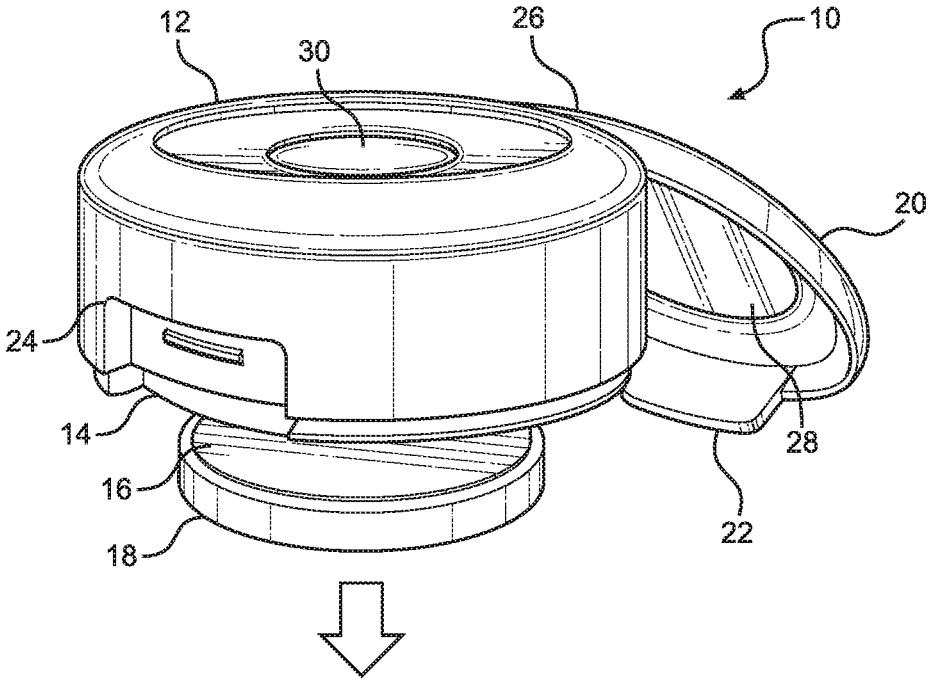
FIG. 4 is a perspective view of the refillable cosmetic compact in an overturned position during ejection of a cosmetic pan.

The refillable cosmetic compact disclosed herein is subject to a variety of embodiments, each within the scope of the invention. However, to ensure that one skilled in the art will be able to understand and, in appropriate cases, practice the present invention, certain preferred embodiments of the broader invention revealed herein are described below and shown in the accompanying drawing figures.

Turning more particularly to the drawings, a refillable cosmetic compact according to the invention is indicated generally at 10 in FIGS. 1 through 4. There, the cosmetic compact 10 can be considered to be founded on a base structure 12. A product base insert 14 is concentrically engaged with the base structure 12. The insert 14 is repositionable in relation to the base structure 12 between an engaged configuration wherein a cosmetic product pan 16 filled with a volume of cosmetic product 18 is retained within a cavity or inner volume of the cosmetic compact 10 and a disengaged configuration wherein a cosmetic product pan 16 can be removed from or inserted into the cosmetic compact 10.

A cover 20 engages with the base structure 12 to have a closed configuration wherein the cavity or inner volume within the cosmetic compact 10 is enclosed and an open configuration wherein the inner volume of the cosmetic compact 10 is open and accessible, such as to permit the access to the cosmetic product 18. The cover 20 has a surface 28. Without limitation, the surface 28 could be a clear window to permit a viewing of the contained cosmetic product 18. Additionally or alternatively, the surface 28 could be mirrored, such as by having a mirror on an inner surface of the cover 20. Still further, the surface 28 could simply be solid material without mirroring and without a window.

In the depicted embodiment, the cover 20 is coupled to the base structure 12 by a hinge 26, and the cover 20 can be selectively retained in the closed configuration by a latch combination formed here by a projecting latch member 22 in cooperation with a receiving latch formation 24. Other coupling and engagement mechanisms, such as a threaded engagement, a snap-fit relationship, or any other effective engagement or coupling mechanism, would be possible and within the scope of the invention.

In this example, the main base structure 12, the product base insert 14, the product pan 16, the cover 20, and the cosmetic compact 10 in general are round, but other shapes are readily possible and within the scope of the invention except as it might be expressly limited by the claims. For instance, rectangular, oval, or other shapes could be employed. Moreover, the depicted cosmetic compact 10 selectively retains just a single cosmetic product pan 16 in the depicted embodiment, but it would likewise be possible and within the scope of the invention for multiple cosmetic product pans 16 to be releasably retained. In constructions of the cosmetic compact 10 adapted for retaining plural cosmetic pans 16, the cosmetic pans 16 could be retained and released individually or with some or all of the cosmetic pans 16 retained and, additionally or alternatively, released in unison or in other structural coordination.

Figure 5:
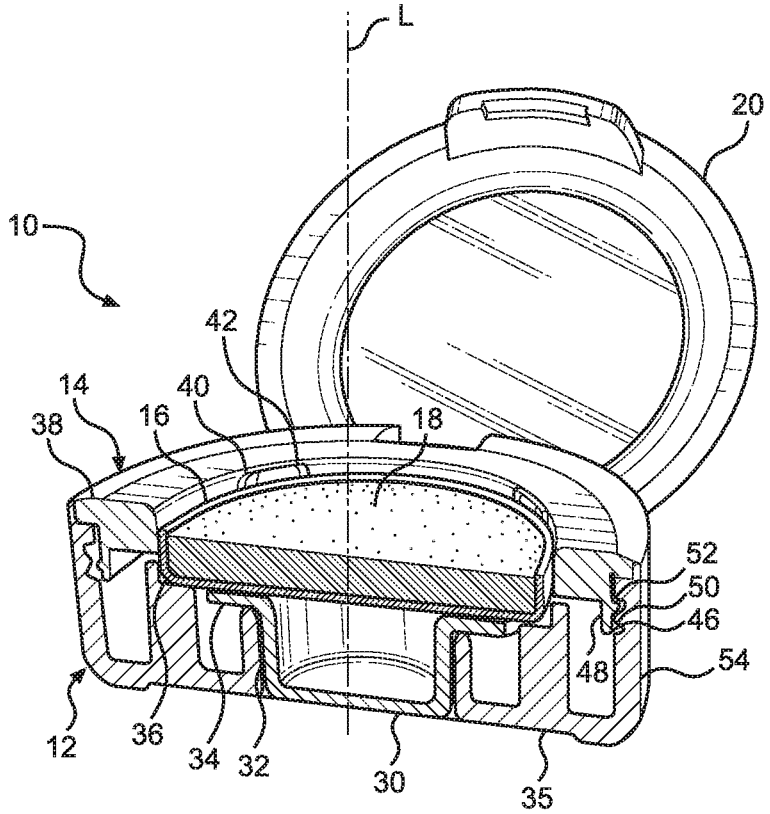
FIG. 5 is a sectioned view of the refillable cosmetic compact in an engaged configuration retaining a cosmetic pan.
Figure 6:
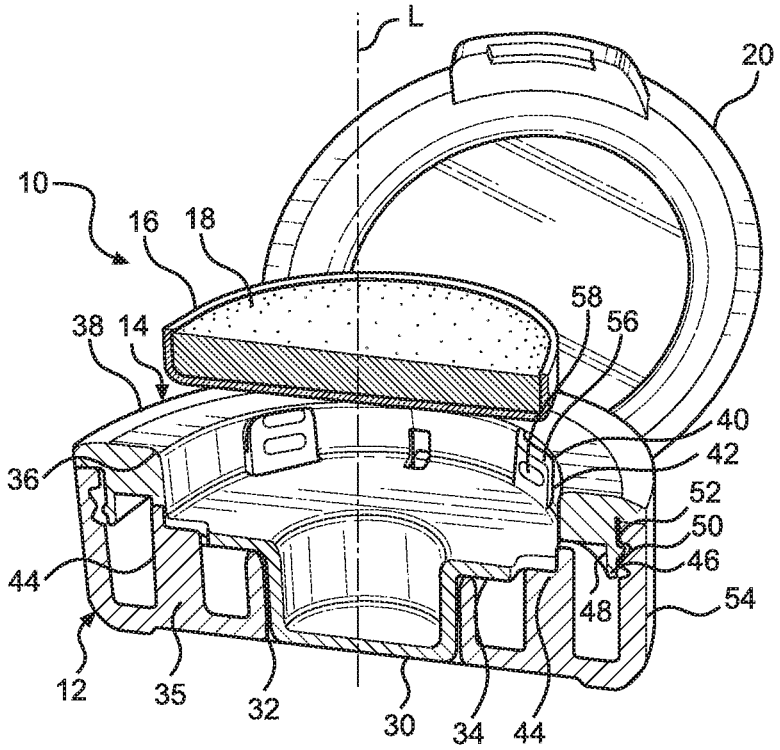
FIG. 6 is a sectioned view of the refillable cosmetic compact in a disengaged configuration.
Figure 7:
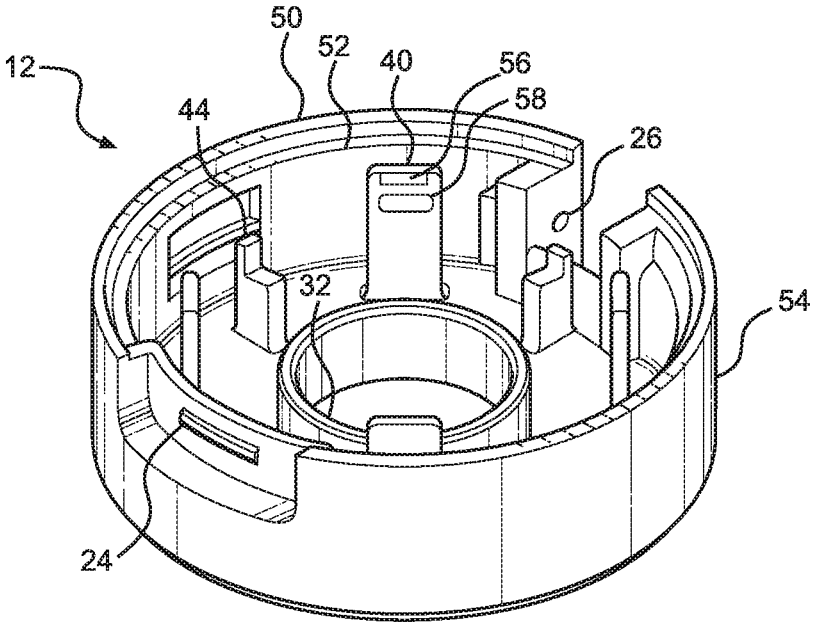
FIG. 7 is a perspective view of a base structure of the refillable cosmetic compact.
Figure 8:
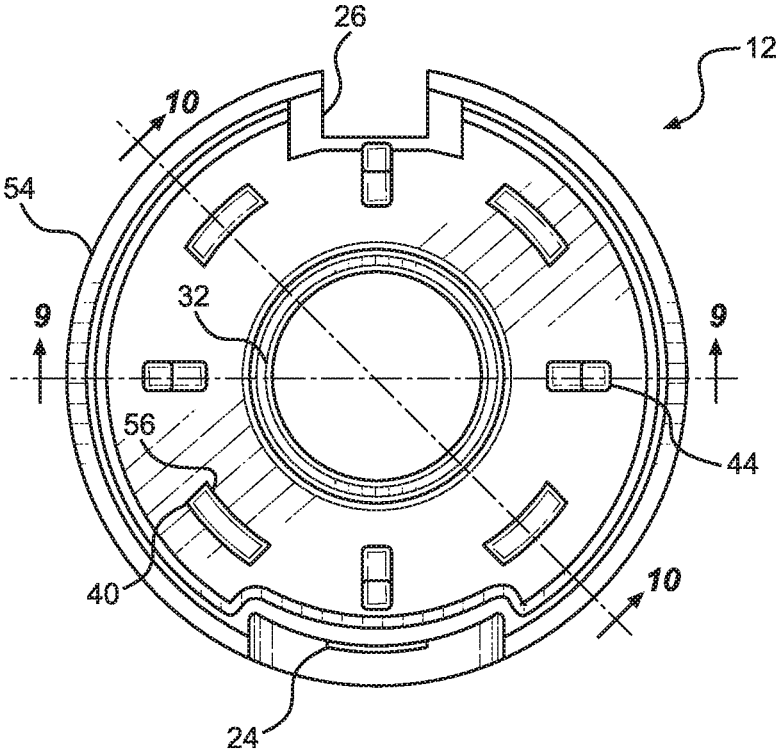
FIG. 8 is a top plan view of the base structure of the refillable cosmetic compact.
Figure 9:
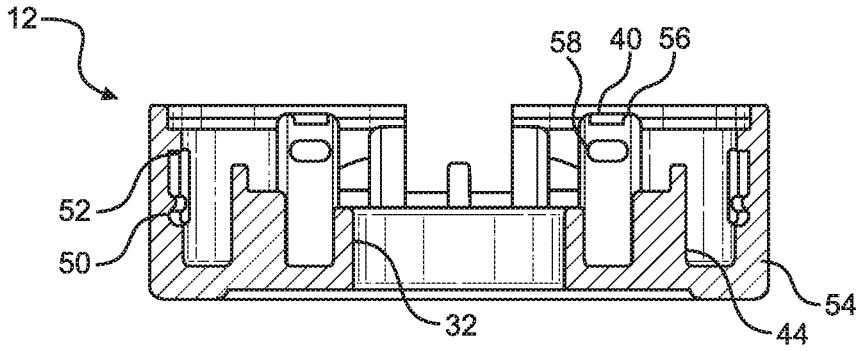
FIG. 9 is a cross section of the base structure taken along the line 9-9 in FIG. 8.
Figure 10:
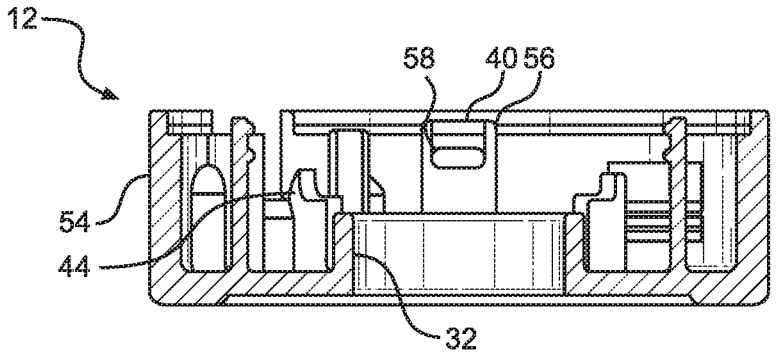
FIG. 10 is a cross section of the base structure taken along the line 10-10 in FIG. 8.
Figure 11:
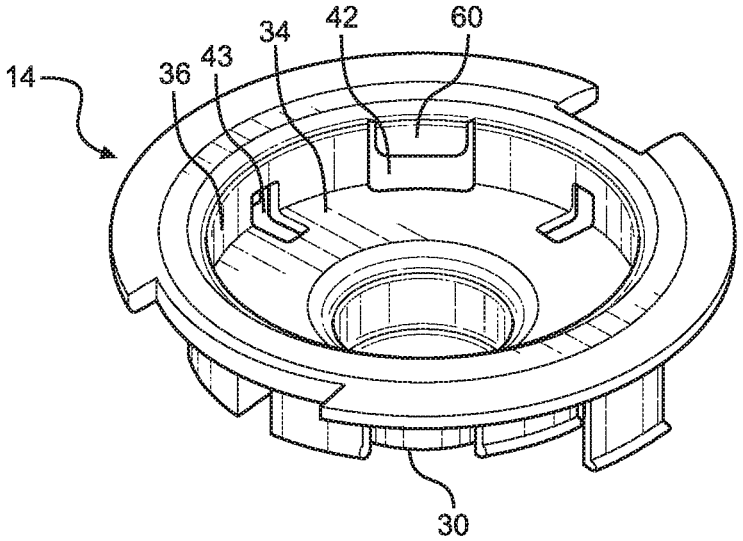
FIG. 11 is a perspective view of a base insert of the refillable cosmetic compact.
Figure 12:
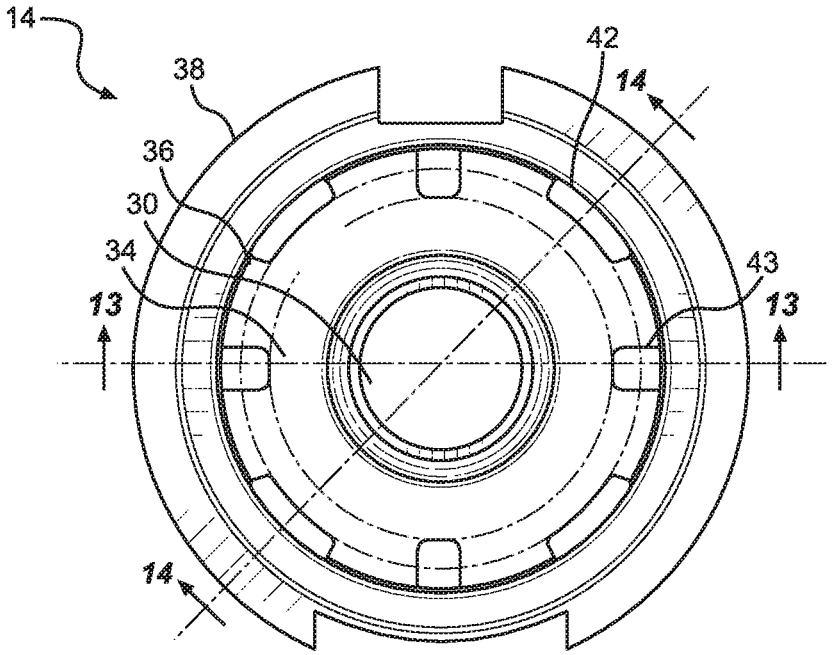
FIG. 12 is a top plan view of the base insert of the refillable cosmetic compact.
Figure 13:
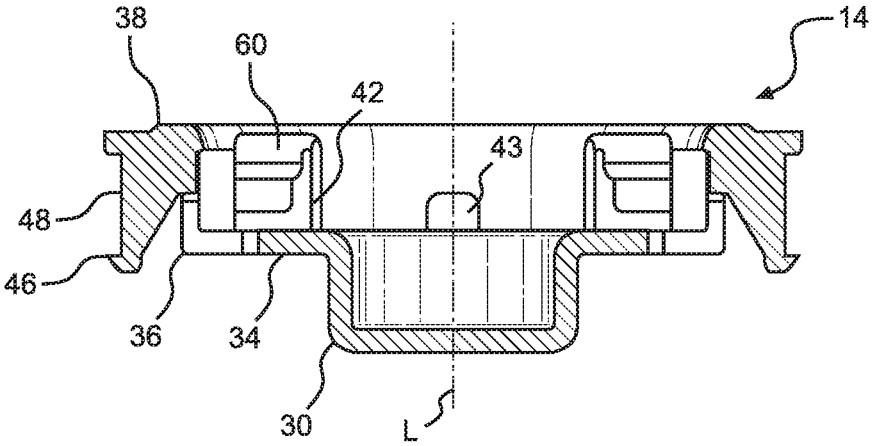
FIG. 13 is a cross section of the base insert taken along the line 13-13 in FIG. 12.

Additional reference may be had to FIGS. 5 and 6 where the cosmetic compact 10 is shown in cross section and FIGS. 7 through 10 where the base structure 12 is shown alone. As in FIGS. 5 and 6, the cosmetic compact 10 can be considered to have a longitudinal direction L and a lateral direction orthogonal to the longitudinal direction L. There, the base structure 12 is depicted to have a floor 35, an outer wall 54 that projects longitudinally from an outer portion of the floor 35, and an inner wall 32 that projects longitudinally from an inner portion of the floor 35 in parallel with the outer wall 54. The floor 35 thus spans laterally between the outer wall 54 and the inner wall 32. The inner wall 32 defines an actuation opening that passes through the base structure 12. In this round embodiment of the cosmetic compact 10, the outer wall 54, the inner wall 32, and the actuation opening are annular in lateral cross section. Together, the inner wall 32 and the outer wall 54 define a toroidal shape. The actuation opening defined by the inner wall 32 is concentric with the outer wall 54. The inner wall 32 and the actuation opening defined thereby are generally tubular.

The product base insert 14, which is shown apart from the remainder of the compact 10 in FIGS. 11 through 14, has a floor 34 on which a cosmetic product pan 16 is supported when engaged and retained by the cosmetic compact 10. The floor 34 and the product base insert 14 in general are in turn supported by the base structure 12 when the base insert 14 is in an engaged position as in FIG. 5. More particularly, the floor 34 of the insert 14 is supported along an inner portion thereof by the upper edge of the inner wall 32 of the base structure 12 and along an outer portion thereof by seat members 44 that project from a mid-portion of the floor 35 of the base structure 12 and are spaced circumferentially around the floor 35. In this example, there are four seat members 44 spaced at 90 degree intervals around the floor 35 with it being understood that fewer or more seat members 44 would be possible.

The product base insert 14 has a release button 30 that is centrally disposed to project longitudinally from an inner portion of the floor 34. In the depicted embodiment, the release button 30 is round in cross section so that it has a tubular outer wall. The release button 30 has a button surface that caps the distal end of the tubular outer wall of the release button 30. The outer wall of the release button 30 here substantially matches the shape of the inner wall 32 of the base structure 12 while being marginally smaller so that the release button 30 is slidably received through at least part of the actuation opening defined by the inner wall 32. The release button 30 has a height approximately matching the height of the inner wall 32 of the base structure 12 so that, when the base insert 14 is fully inserted into the base structure 12 in an engaged position, a substantially continuous surface is presented by the floor 35 and the button surface of the release button 30.

A sidewall 36 of the product base insert 14 projects longitudinally from an outer portion of the floor 34 of the insert 14 in a direction opposite to that in which the release button 30 projects. The sidewall 36 has an inner surface that matches the outer peripheral shape of the cosmetic product pan 16 while being marginally larger than the pan 16 so that the cosmetic product pan 16 can be matingly received into the volume defined by the sidewall 36. When inserted into the base insert 14 and into the cosmetic compact 10 in general, the cosmetic pan 16 has a seated position with the bottom of the pan 16 in facing contact with the floor 34 of the insert 14 and the sidewall of the pan 16 surrounded by the sidewall 36 of the insert 14.

In this round embodiment with a single cavity for retaining a single cosmetic pan 16, the product base insert 14 has a rim 38 that projects laterally outward from an upper or distal end of the sidewall 36 to encircle the sidewall 36. In other embodiments, the structure of the rim 38 could span between adjacent cavities or be otherwise disposed or shaped. The rim 38 in this example has an outer peripheral size and shape approximating the size and shape of the edge of the outer wall 54 of the base structure 12. Accordingly, when the product base insert 14 is fully inserted into the base structure 12 in an engaged position, the rim 38 overlies the upper end of the outer wall 54 of the base structure 12.

With reference to FIGS. 5 through 10, a plurality of deflectable product pan catch members 40 are retained by the base structure 12. In this embodiment, the catch members 40 project generally in the longitudinal direction L and from the floor 35 of the base structure 12. There are four catch members 40 in this non-limiting example evenly spaced at 90-degree intervals along a circumference of a circular shape concentric with the inner and outer walls 32 and 54. Each catch member 40 has a retaining formation 56 comprising an inwardly-projecting formation with a proximally-disposed ledge disposed at a distal end of the catch member 40. One or more additional protuberances 58 could be disposed along the longitudinal length of the catch members 40. The catch members 40 are resiliently deflectable in relation to the floor 35 and the base structure 12 in general.

A plurality of apertures 42 are disposed in the product base insert 14 corresponding in size and location to the plurality of catch members 40 for longitudinally receiving the catch members 40. The catch members 40 are thus interposed between sections of the sidewall 36 of the base insert 14 when the base insert 14 and the base structure 12 are fully engaged. The catch members 40 cooperate with the floor 34 and the sidewall 36 of the insert 14 to define the inner volume for receiving the product pan 16. The apertures 42 in the product base insert 14 are substantially L-shaped with a base of the L shape comprising a space within the floor 34 and a bottom of the sidewall 36 and the upstanding portion of the L shape comprising an opening in the sidewall 36. When the product base insert 14 is inserted into the base structure 12, the catch members 40 are received into and occupy the apertures 42 such that the catch members 40 are generally contiguous with the sidewall 36 of the insert 14.

When in a relaxed, non-deflected configuration, the catch members 40 are disposed along a circular shape sufficient in size to permit the insertion and removal of a product pan 16 from its seated position on the floor 34 of the insert 14. More particularly, the catch members 40 are disposed in a non-deflected configuration with the inner surfaces of the catch members 40, such as the inner surfaces formed by the retaining formations 56 and the protuberances 58, disposed along circular shapes equal to or greater in circumference than the circumference of the product pan 16.

Figure 14:
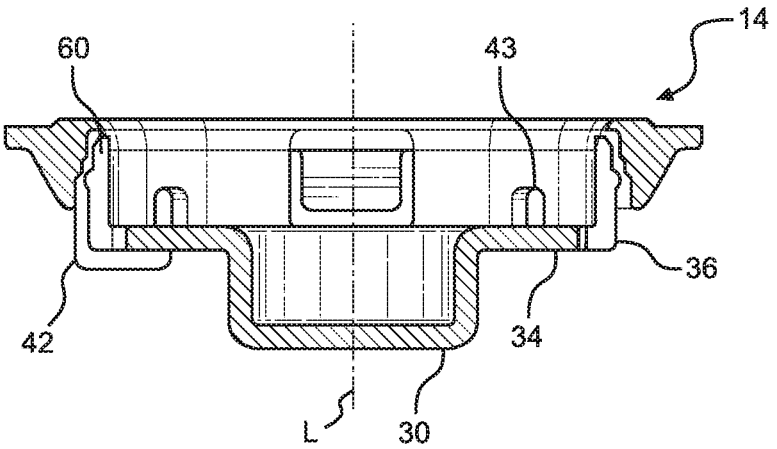
FIG. 14 is a cross section of the base insert taken along the line 14-14 in FIG. 12.

As best seen perhaps in the cross-sectional view of FIG. 14, the product base insert 14 has converging surfaces 60 disposed in distal portions of the apertures 42. The converging surfaces 60 comprise sloped portions that converge toward the longitudinal centerline L of the product base insert 14 from a proximal portion of the converging surface 60 to a distal portion of the converging surface 60. One or more portions of each converging surface 60 can slope inwardly or converge from the proximal portion to the distal portion thereof, or the entire converging surface 60 can slope inwardly on a continuous or substantially continuous slope. In this example, each converging surface 60 has a sloped portion that converges at approximately 30 degrees toward the longitudinal centerline L of the product base insert 14.

The converging surfaces 60 are positioned to engage the outwardly facing surfaces of the distal portions of the catch members 40 as the product base insert 14 is moved from the released or disengaged position in relation to the base structure 12 as in FIG. 6 to an engaged or retention configuration in relation to the base structure 12 as in FIG. 5. The converging surfaces 60 disengage the outwardly facing surfaces of the distal portions of the catch members 40 as the product base insert 14 is moved from the engaged position of FIG. 5 to the disengaged position of FIG. 6. For instance, the converging surfaces 60 can slope from being disposed along a circular shape with a circumference greater than a circumference of a circular shape along which the outwardly facing surfaces of the catch members 40 are disposed when in a non-deflected configuration to being disposed along a circular shape with a circumference less than the circumference of the circular shape along which the outwardly facing surfaces of the catch members 40 are disposed when the catch members 40 are in a non-deflected configuration.

When the product base insert 14 is adjusted from the disengaged position to the engaged position, the catch members 40 are thus deflected inwardly from their non-deflected, disengaged position to an inwardly-deflected, engaged position. In the engaged position, the catch members 40 are operative to engage and retain a cosmetic pan 16. In this embodiment, the catch members 40 are inwardly deflected to be disposed along a shape, in this case a circular shape, wherein the retaining formations 56 of the catch members 40 mechanically engage the product pan 16. Here, the retaining formations 56 are induced to overlie an edge of the product pan 16 while the protuberances 58 engage the sidewall of the product pan 16. Other engagements, such as engagements of the catch members 40 into notches or other formations of the product pan 16, are possible within the scope of the invention.

The cosmetic compact 10 has a latching mechanism for adjustably retaining the product base insert 14 in the engaged configuration and in the disengaged configuration. The latching mechanism in this embodiment is formed by at least one ridge 46 retained by the product base insert 14 and at least one ridge 50 retained by the base structure 12 wherein the ridges 46 and 50 can be forced over to pass over one another in a snap-fit engagement to establish a snap-fit latching mechanism. In the depicted embodiment, the product base insert 14 has plural, such as four or more or fewer, outwardly facing ridges 46 circumferentially spaced around the product base insert 14, and the base structure 12 has a corresponding plurality of inwardly facing ridges 50 that are disposed to have an interference, snap-fit in relation to the ridges 46 of the product base insert 14. While such snap-fit latching mechanisms could vary within the scope of the invention, the ridges 46 of the product base insert 14 in this construction are retained by latch members 48 that depend longitudinally from the rim 38, and the ridges 50 of the base structure 12 project inwardly from within grooves 52 in the outer wall 54 of the base structure 12.

The product base insert 14 can thus be snapped from the disengaged position of FIG. 6 to the engaged position of FIG. 5 by, for instance, pressing on the rim 38 of the base insert 14 or squeezing the rim 38 and the base structure 12 to cause the ridges 46 to pass over the ridges 50 in a first longitudinal direction. The product base insert 14 will thus tend to be retained in the engaged position by operation of the interference between the ridges 46 and 50 of the latching mechanism. Further, the product base insert 14 can be snapped from the engaged position of FIG. 5 to the disengaged position of FIG. 6 by a pressing on, for instance, the release button 30 to cause the ridges 46 to pass over the ridges 50 in a second longitudinal direction. By operation of the ridges 46 and 50 of the latching mechanism, the product base insert 14 will tend to be retained in the disengaged position.

Under this construction, with the inner volume of the cosmetic compact 10 empty and with the product base insert 14 in the disengaged position of FIG. 6, a cosmetic product pan 16 retaining a volume of cosmetic 18 can be inserted into the reception volume within the product base insert 14 to have the bottom of the cosmetic product pan 16 disposed atop the floor 34 of the product base insert 14. The product base insert 14 and the retained cosmetic product pan 16 can then be pressed into engagement with the base structure 12, such as by a pressing on the rim 38 or a squeezing together of the rim 38 and the floor 35 of the base structure 12. With the application of force, the ridges 46 and 50 will tend to pass or snap over one another, and the product base insert 14 will become fully seated within the base structure 12 to reach the engaged or retention configuration. As the product base insert 14 moves into the engaged configuration with the base structure 12, the inwardly-facing converging surfaces 60 engage the outer surfaces of the catch members 40. As the tips of the catch members 40 slide over the sloped portions of the converging surfaces 60, the catch members 40 are deflected inwardly toward the longitudinal centerline L of the compact 10 to cause the catch members 40 to converge on the cosmetic product pan 16. In this embodiment, the protuberances 58 of the catch members 40 are pressed into engagement with the sidewall of the product pan 16, and the retaining formations 56 are pressed into position overlying the edge of the product pan 16. With that, the cosmetic product pan 16 is locked into position within the cosmetic compact 10.

When desired, such as when a volume of cosmetic 18 is spent from the cosmetic product pan 16 or when the color or type of cosmetic 18 is desired to be changed, the cosmetic product pan 16 can be conveniently ejected or disengaged from the cosmetic compact 10 by a pressing on the release button 30 of the product base insert 14 that is exposed through the actuation opening 32 of the base structure 12. When the release button 30 is pressed with sufficient force, the ridges 46 and 50 will overcome the interference fit and pass over one another to permit the product base insert 14 to move from the engaged configuration of FIG. 5 to the disengaged configuration of FIG. 6. As the product base insert 14 moves into the disengaged configuration in relation to the base structure 12, the inwardly-facing converging surfaces 60 disengage from the outer surfaces of the catch members 40. As the tips of the catch members 40 slide over the sloped portions of the converging surfaces 60, the catch members 40 deflect by their resilience outwardly away from the longitudinal centerline L of the compact 10 to cause the catch members 40 to diverge from the cosmetic product pan 16. The protuberances 58 of the catch members 40 move outwardly away from engagement with the sidewall of the product pan 16, and the retaining formations 56 move outwardly away from their position overlying the edge of the product pan 16. The cosmetic product pan 16 is thus released from its position within the cosmetic compact 10. As shown, for instance, in FIG. 4, the cosmetic compact 10 might be overturned to allow the cosmetic product pan 16 to be ejected. Additionally or alternatively, a user might remove the released cosmetic product pan 16 manually.

Numerous other embodiments of the cosmetic compact 10 are possible and within the scope of the invention except as it may be expressly limited by the claims. While the illustrative example of FIGS. 1 through 14 is round with a single receiving and retaining volume for a single cosmetic pan 16, rectangular, oval, or other shapes could be employed and multiple cosmetic product pans 16 could be releasably retained.

One possible alternative embodiment of the invention is depicted in FIGS. 15 through 19 where the cosmetic compact is again indicated at 10. There, the cosmetic compact 10 pursues a rectangular formation for retaining a rectangular cosmetic pan 16 that itself retains a rectangular volume of cosmetic 18. The base structure 12 has a rectangular floor 35, an outer wall structure 54 comprising four rectangularly-disposed walls that projects longitudinally from an outer portion of the floor 35, and an inner wall 32 that projects longitudinally from an inner portion of the floor 35. The floor 35 thus spans laterally between the outer wall 54 and the inner wall 32. The inner wall 32 defines an actuation opening that passes through the base structure 12. In this rectangular embodiment of the cosmetic compact 10, the inner wall 32 and the actuation opening can be annular, rectangular, or some other cross-sectional shape. The actuation opening 32 defined by the inner wall 32 is centered within the outer wall 54.

The product base insert 14 has a floor 34 on which a cosmetic product pan 16 is supported when engaged and retained by the cosmetic compact 10. The floor 34 and the product base insert 14 in general are in turn supported by the base structure 12 when the base insert 14 is in an engaged position as in FIG. 15. More particularly, the floor 34 of the insert 14 is supported along an inner portion thereof by the upper edge of the inner wall 32 of the base structure 12 and along an outer portion thereof by seat members 44 that project from a mid-portion of the floor 35 of the base structure 12 and are spaced evenly around the floor 35. In this example, there are four seat members 44 spaced at 90 degree intervals around the floor 35 with it being understood that fewer or more seat members 44 would be possible.

The product base insert 14 has a release button 30 that is centrally disposed to project longitudinally from an inner portion of the floor 34. The release button 30 has a cross section matching the shape of the inner wall 32 of the base structure 12 while being marginally smaller so that the release button 30 is slidably received through at least part of the actuation opening defined by the inner wall 32. The release button 30 has a button surface that caps the distal end of the tubular outer wall of the release button 30. The release button 30 has a height approximately matching the height of the inner wall 32 of the base structure 12 so that, when the base insert 14 is fully inserted into the base structure 12 in an engaged position, a substantially continuous surface is presented by the floor 35 and the button surface of the release button 30.

A sidewall 36 of the product base insert 14 projects longitudinally from an outer portion of the floor 34 of the insert 14 in a direction opposite to that in which the release button 30 projects. The sidewall 34 has a rectangular inner surface that matches the outer peripheral shape of the cosmetic product pan 16 while being marginally larger than the pan 16 so that the cosmetic product pan 16 can be matingly received into the volume defined by the sidewall 34. When inserted into the base insert 14 and into the cosmetic compact 10 in general, the cosmetic pan 16 has a seated position with the bottom of the pan 16 in facing contact with the floor 34 of the insert 14 and the sidewall of the pan 16 surrounded by the sidewall 36 of the insert 14.

The product base insert 14 has a rim 38 that projects laterally outward from an upper or distal end of the sidewall 36 to encircle the sidewall 36. The rim 38 has a rectangular outer peripheral size and shape approximating the rectangular size and shape of the edge of the outer wall 54 of the base structure 12. Accordingly, when the product base insert 14 is fully inserted into the base structure 12 in an engaged position, the rim 38 overlies the upper end of the outer wall 54 of the base structure 12.

Figure 18:
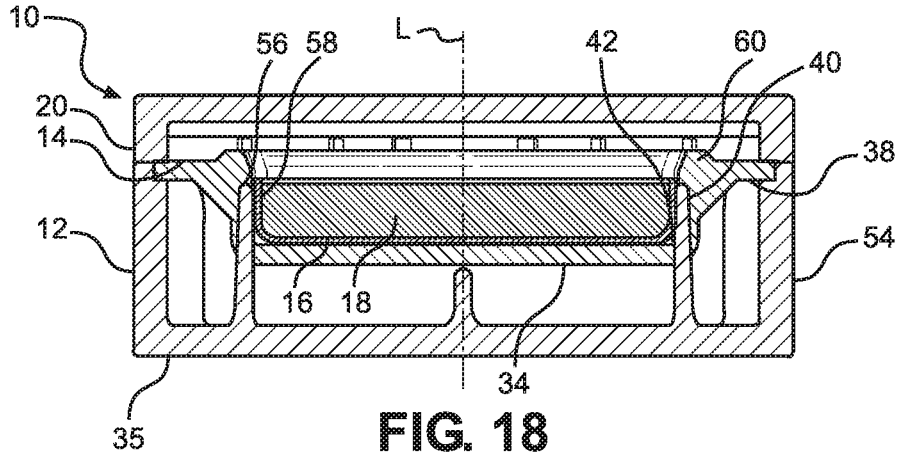
FIG. 18 is a cross section of the refillable cosmetic compact taken along the line 18-18 in FIG. 15.
Figure 19:
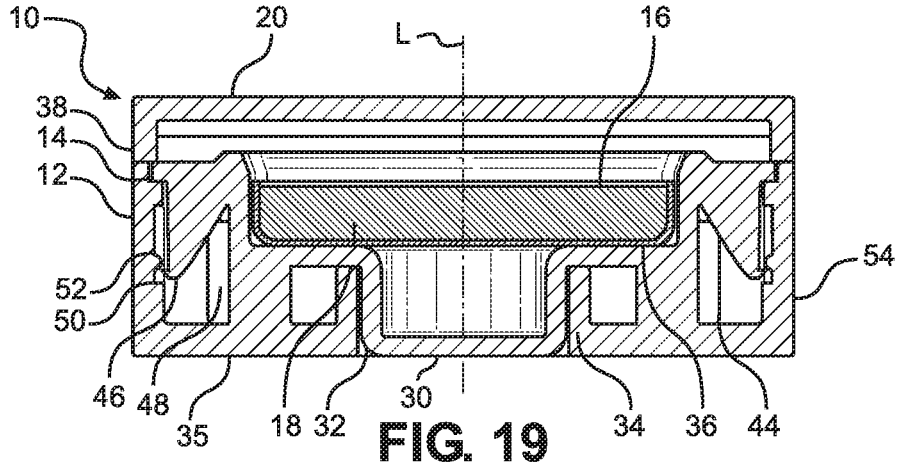
FIG. 19 is a cross section of the refillable cosmetic compact taken along the line 19-19 in FIG. 15.
Figure 20:
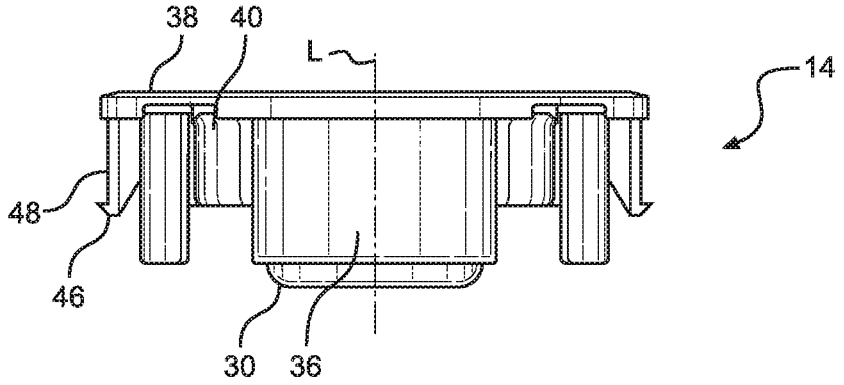
FIG. 20 is a view in side elevation of a product base insert of an alternative refillable cosmetic compact according to the invention.
Figure 21:
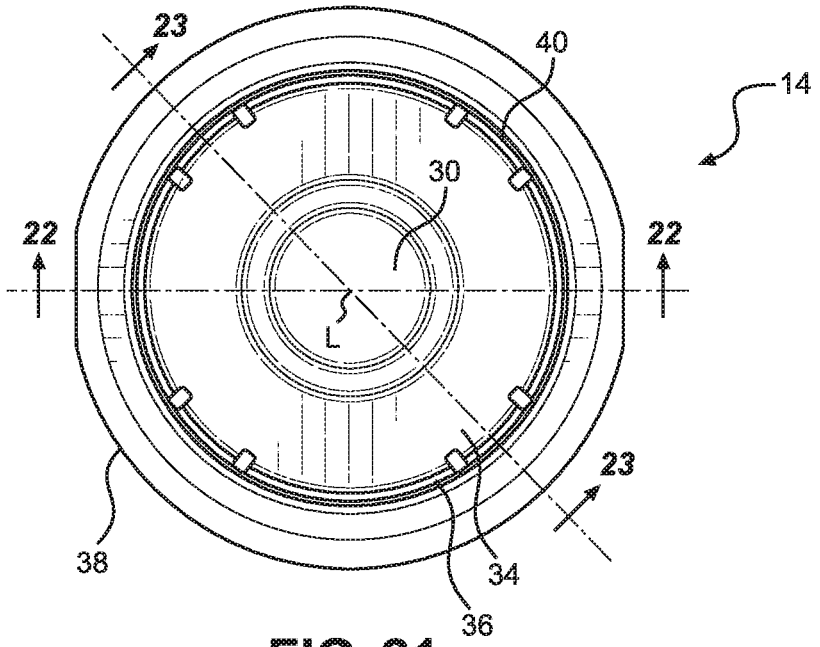
FIG. 21 is a top plan view of the product base insert of FIG. 20.
Figure 22:
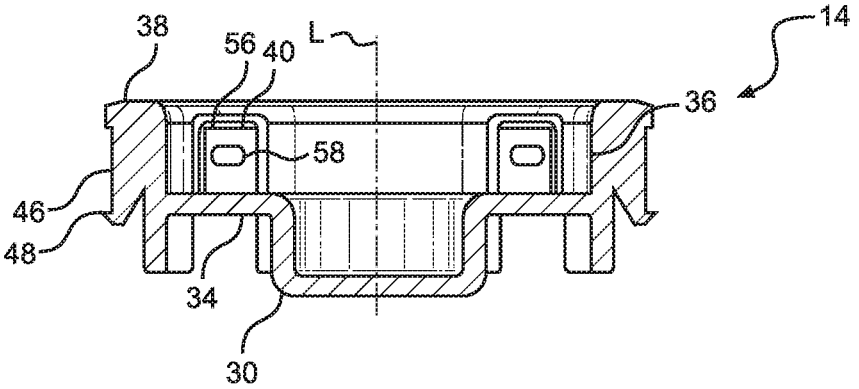
FIG. 22 is a cross section of the base insert taken along the line 22-22 in FIG. 22.
Figure 23:
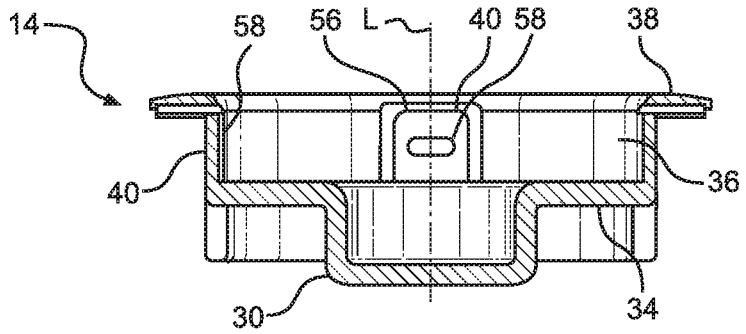
FIG. 23 is a cross section of the base insert taken along the line 23-23 in FIG. 22.
Figure 24:
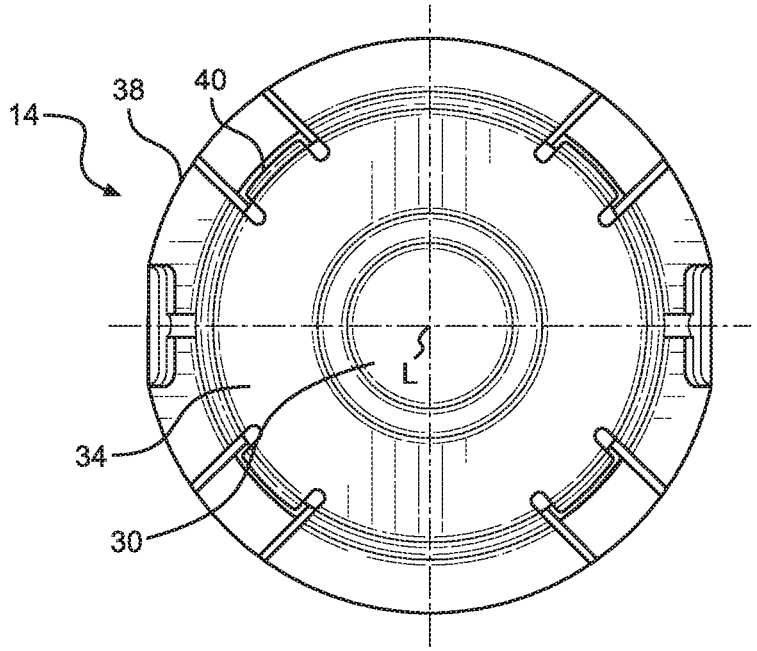
FIG. 24 is a bottom plan view of the product base insert of FIG. 20.

With reference to FIG. 18, a plurality of product pan catch members 40 project generally in the longitudinal direction L from the floor 35 of the base structure 12. In this example, there are four catch members 40 with two catch members 40 disposed to each of first and second opposite sides of the product base insert 14. Each catch member 40 has a retaining formation 56 comprising an inwardly-projecting formation with a proximally-disposed ledge disposed at a distal end of the catch member 40. Additional protuberances 58 are disposed along the longitudinal length of the catch members 40. The catch members 40 are resiliently deflectable in relation to the floor 35 and the base structure 12 in general.

A plurality of apertures 42 are disposed in the product base insert 14 corresponding in size and location to the plurality of catch members 40 for longitudinally receiving the catch members 40. The catch members 40 are thus interposed between sections of the sidewall 36 of the base insert 14. The catch members 40 cooperate with the floor 34 and the sidewall 36 of the insert 14 to define the inner volume for receiving the product pan 16. The apertures 42 in the product base insert 14 are substantially L-shaped with a base of the L shape comprising a space within the floor 34 and a bottom of the sidewall 36 and the upstanding portion of the L shape comprising an opening in the sidewall 36. When the product base insert 14 is inserted into the base structure 12, the catch members 40 are received into and occupy the apertures 42 such that the catch members 40 are generally contiguous with the sidewall 36 of the insert 14.

When in a relaxed, non-deflected configuration, the catch members 40 are spaced with a lateral distance between them sufficient to permit the insertion and removal of a product pan 16 from its seated position on the floor 34 of the insert 14. More particularly, the catch members 40 are disposed in a non-deflected configuration with the inner surfaces of the catch members 40, such as the inner surfaces formed by the retaining formations 56 and the protuberances 58, spaced apart a distance equal to or greater than the corresponding width of the product pan 16.

As best seen in the cross-sectional view of FIG. 18, the product base insert 14 has converging surfaces 60 disposed in distal portions of the apertures 42. The converging surfaces 60 comprise sloped portions that converge toward the longitudinal centerline L of the product base insert 14 from a proximal portion of the converging surface 60 to a distal portion of the converging surface 60. One or more portions of each converging surface 60 can slope inwardly or converge from the proximal portion to the distal portion thereof, or the entire converging surface 60 can slope inwardly on a continuous or substantially continuous slope. In this example, each converging surface 60 has a sloped portion that converges at approximately 30 degrees toward the longitudinal centerline L of the product base insert 14.

Figure 15:
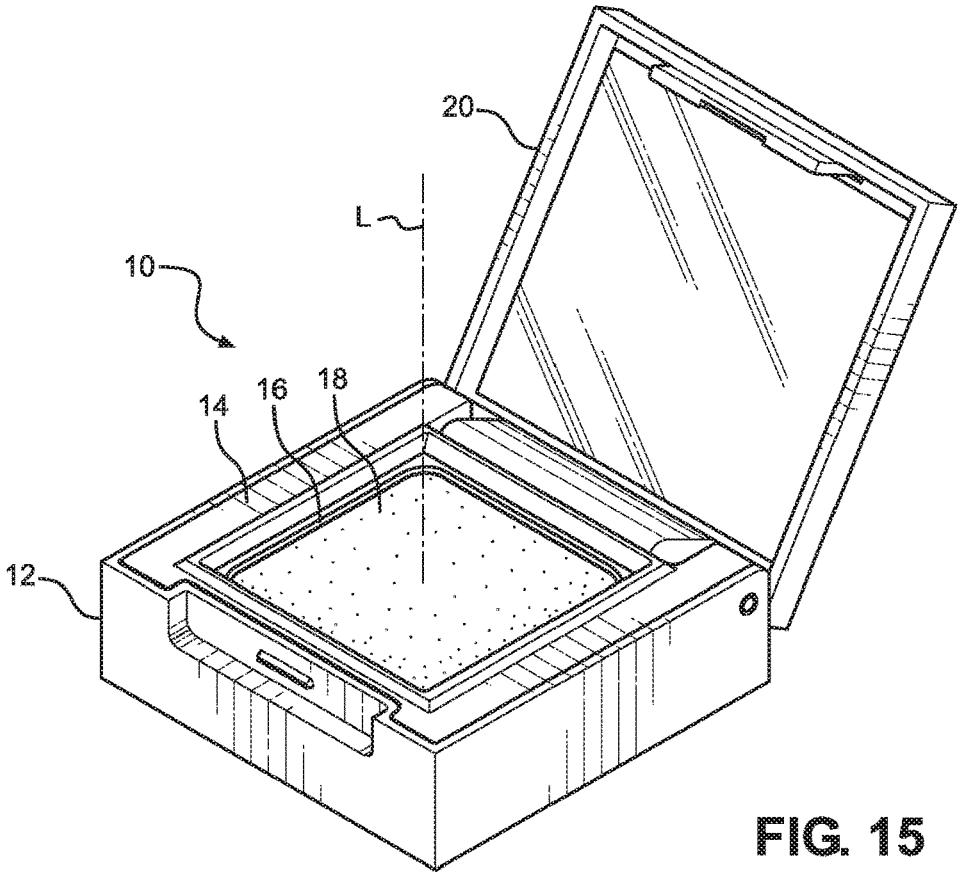
FIG. 15 is a perspective view of an alternative refillable cosmetic compact as disclosed herein retaining a pan of cosmetic material.
Figure 16:
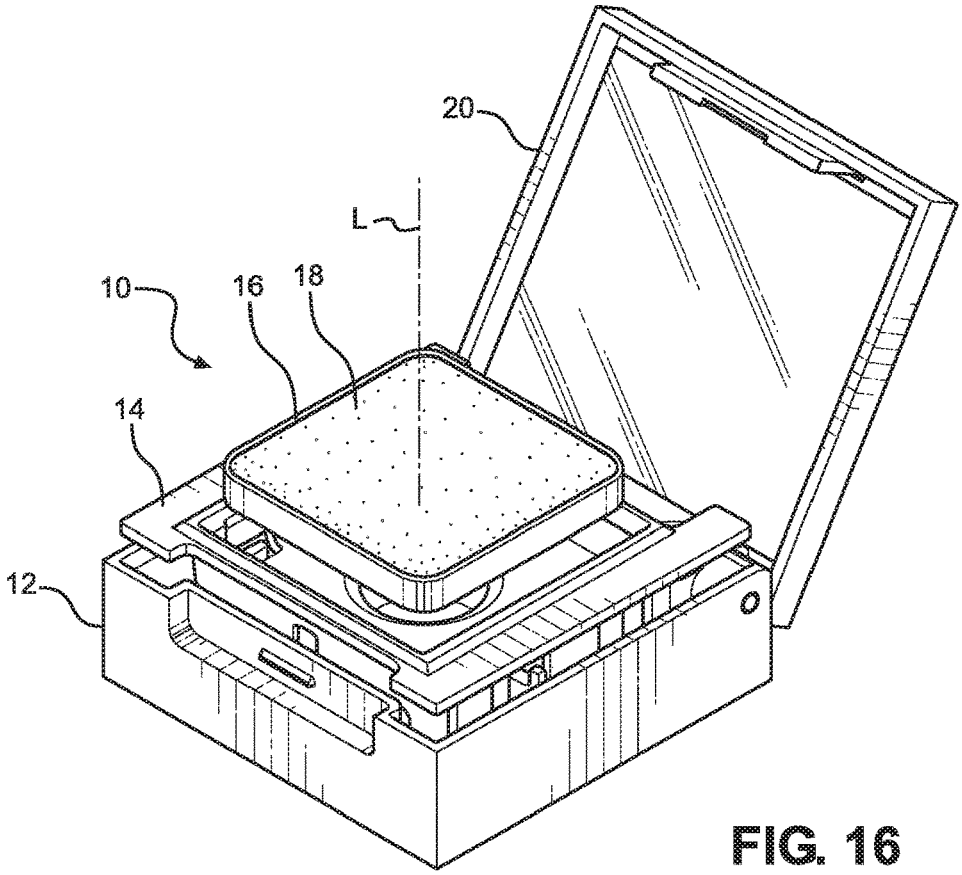
FIG. 16 is a perspective view of the refillable cosmetic compact of FIG. 15 with the cosmetic pan released.
Figure 17:
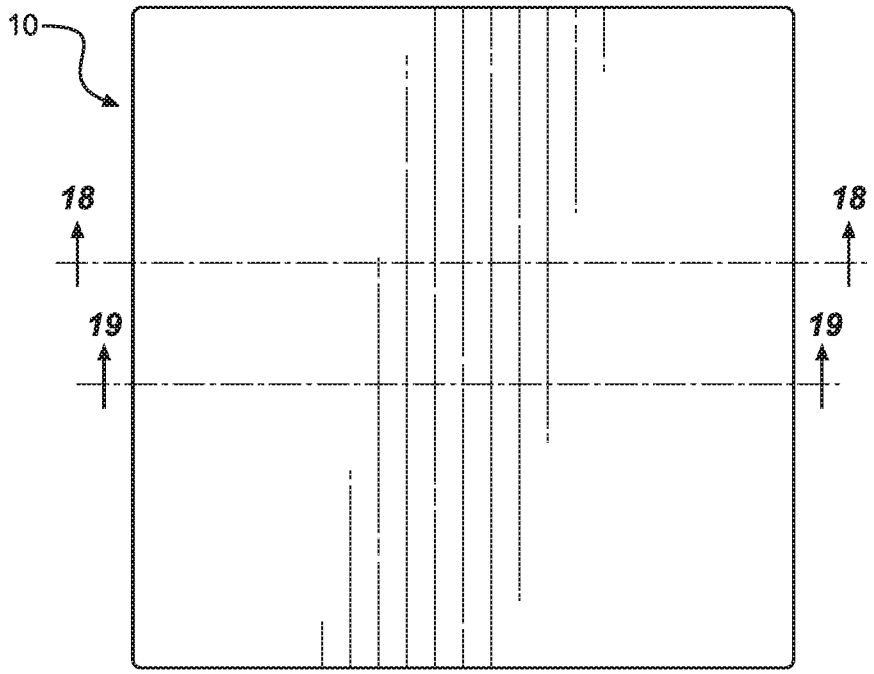
FIG. 17 is a top plan view of the refillable cosmetic compact of FIG. 15.

The converging surfaces 60 are positioned to engage the outwardly facing surfaces of the distal portions of the catch members 40 as the product base insert 14 is moved from the released or disengaged position in relation to the base structure 12 as in FIG. 16 to an engaged or retention configuration in relation to the base structure 12 as in FIG. 15. The converging surfaces 60 disengage the outwardly facing surfaces of the distal portions of the catch members 40 as the product base insert 14 is moved from the engaged position of FIG. 15 to the disengaged position of FIG. 16. For instance, the converging surfaces 60 can slope from being spaced a distance greater than a distance between the outwardly facing surfaces of the catch members 40 to being spaced a distance less than the distance between the outwardly facing surfaces of the catch members 40 when the catch members 40 are in a non-deflected configuration.

When the product base insert 14 is adjusted from the disengaged position to the engaged position, the catch members 40 are thus deflected inwardly from their non-deflected, disengaged position to an inwardly-deflected, engaged position. In the engaged position, the catch members 40 are operative to engage and retain the cosmetic pan 16. In this embodiment, the catch members 40 are inwardly deflected to cause the retaining formations 56 of the catch members 40 to engage the product pan 16 mechanically by overlying an edge of the product pan 16 while the protuberances 58 engage the sidewall of the product pan 16.

The cosmetic compact 10 again has a latching mechanism for adjustably retaining the product base insert 14 in the engaged configuration and in the disengaged configuration, the latching mechanism formed by at least one ridge 46 retained by the product base insert 14 and at least one ridge 50 retained by the base structure 12. The ridges 46 and 50 are spaced in opposition to be forced over to pass over one another in a snap-fit engagement thereby establishing a snap-fit latching mechanism. Here, the product base insert 14 has plural outwardly facing ridges 46 disposed in opposed pairs, and the base structure 12 has a corresponding plurality of inwardly facing ridges 50 that are disposed to have an interference, snap-fit in relation to the ridges 46 of the product base insert 14. The ridges 46 of the product base insert 14 in this construction are retained by latch members 48 that depend longitudinally from the rim 38, and the ridges 50 of the base structure 12 project inwardly from within grooves 52 in the outer wall 54 of the base structure 12.

The product base insert 14 can thus be snapped from the disengaged position of FIG. 16 to the engaged position of FIG. 15 by a pressing on, for instance, the rim 38 of the base insert 14 or a squeezing of the rim 38 and the base structure 12 to cause the ridges 46 to pass over the ridges 50 in a first longitudinal direction. The product base insert 14 will thus tend to be retained in the engaged position by operation of the interference between the ridges 46 and 50 of the latching mechanism. Further, the product base insert 14 can be snapped from the engaged position of FIG. 15 to the disengaged position of FIG. 16 by a pressing on, for instance, the release button 30 to cause the ridges 46 to pass over the ridges 50 in a second longitudinal direction. By operation of the ridges 46 and 50 of the latching mechanism, the product base insert 14 will tend to be retained in the disengaged position.

In use, a cosmetic product pan 16 retaining a volume of cosmetic 18 can be inserted into the reception volume within the product base insert 14 to have the bottom of the cosmetic product pan 16 disposed atop the floor 34 of the product base insert 14. The product base insert 14 and the retained cosmetic product pan 16 can then be pressed into engagement with the base structure 12, such as by a pressing on the rim 38 or a squeezing together of the rim 38 and the floor 35 of the base structure 12. With the application of force, the ridges 46 and 50 will tend to pass or snap over one another, and the product base insert 14 will become fully seated within the base structure 12 to reach the engaged or retention configuration. As the product base insert 14 moves into the engaged configuration with the base structure 12, the inwardly-facing converging surfaces 60 engage the outer surfaces of the catch members 40. As the tips of the catch members 40 slide over the sloped portions of the converging surfaces 60, opposed catch members 40 are deflected inwardly toward one another to cause the catch members 40 to converge on the cosmetic product pan 16. In this embodiment, the protuberances 58 of the catch members 40 are pressed into engagement with the sidewall of the product pan 16, and the retaining formations 56 are pressed into position overlying the edge of the product pan 16. With that, the cosmetic product pan 16 is locked into position within the cosmetic compact 10.

The cosmetic product pan 16 can be ejected or disengaged from the cosmetic compact 10 by a pressing on the release button 30 of the product base insert 14, which is exposed and accessible through the actuation opening 32 of the base structure 12. When the release button 30 is pressed with sufficient force, the ridges 46 and 50 will overcome the interference fit and pass over one another to permit the product base insert 14 to move from the engaged configuration of FIG. 15 to the disengaged configuration of FIG. 16. As the product base insert 14 moves into the disengaged configuration in relation to the base structure 12, the inwardly-facing converging surfaces 60 disengage from the outer surfaces of the catch members 40. As the tips of the catch members 40 slide over the sloped portions of the converging surfaces 60, the catch members 40 deflect by their resilience outwardly to cause the catch members 40 to diverge from the cosmetic product pan 16, and the retaining formations 56 move outwardly away from their position overlying the edge of the product pan 16. The cosmetic product pan 16 is thus released from its position within the cosmetic compact 10.

In the embodiment of the cosmetic compact 10 of FIGS. 1 through 19, the product pan catch members 40 are retained by the base structure 12 to project generally in the longitudinal direction L upwardly from the floor 35 of the base structure 12. However, it would be within the scope of the invention for the catch members 40 to be otherwise retained and otherwise disposed. By way of example, the catch members 40 could alternatively be retained to project downwardly from an upper portion of the base structure 12. Catch members 40 could alternatively, or even additionally, project from a portion of the product base insert 14 with deflection surfaces, such as but not necessarily limited to converging surfaces 60, then being retained by the base structure 12. Catch members 40 might, for example, project generally in the longitudinal direction L downwardly from a portion of the product base insert 40, or catch members 40 might project generally in the longitudinal direction L upwardly from a portion of the product base insert 14. The deflection surfaces could comprise wedges, protuberances, sloped surfaces, or any other surface operative to cause the catch members 40 to deflect to retain the product pan 16 and the product 18 when the product base insert 14 is fully inserted into the base structure 12.

In the non-limiting example of the cosmetic compact 10 of FIGS. 20 through 26, for instance, plural deflectable product pan catch members 40 are retained by the product base insert 14 to be deflected inwardly when the product base insert 14 is inserted into the base structure 12. The catch members 40 project generally in the longitudinal direction L and from the floor 34 of the product base insert 14. There are four catch members 40 evenly spaced at 90-degree intervals along a circumference of a circular shape concentric with the sidewall 36. Here, when in a relaxed position, the catch members 40 are disposed along a circumference, generally matching the circumference of the sidewall 36. The catch members 40 are thus interposed between sections of the sidewall 36 of the base insert 14 to cooperate with the floor 34 and the sidewall 36 of the insert 14 to define the inner volume for receiving the product pan 16. Each catch member 40 has a retaining formation 56 comprising an inwardly-projecting formation with a proximally-disposed ledge disposed at a distal end of the catch member 40. One or more additional protuberances 58 are disposed along the longitudinal length of each catch member 40. The catch members 40 are resiliently deflectable in relation to the floor 34 and the product base insert 14 in general.

When in a relaxed, non-deflected configuration, the catch members 40 are disposed along a circular shape sufficient in size to permit the insertion and removal of the product pan 16 from its seated position on the floor 34 of the insert 14. The catch members 40 are disposed in a non-deflected configuration with the inner surfaces of the catch members 40, such as the inner surfaces formed by the retaining formations 56 and the protuberances 58, disposed along circular shapes equal to or greater in circumference than the circumference of the product pan 16.

Figure 25:
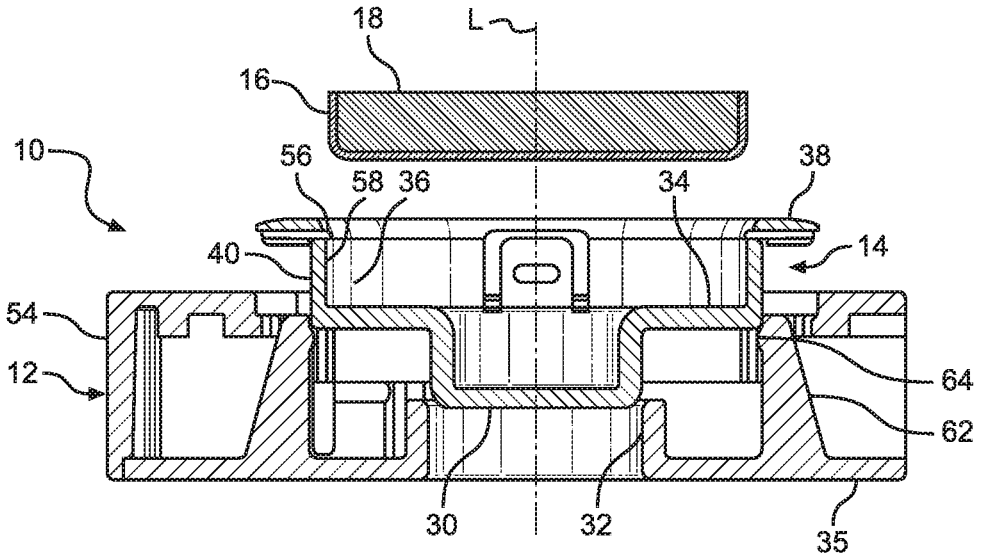
FIG. 25 is a sectioned view of the refillable cosmetic compact in a disengaged configuration.
Figure 26:
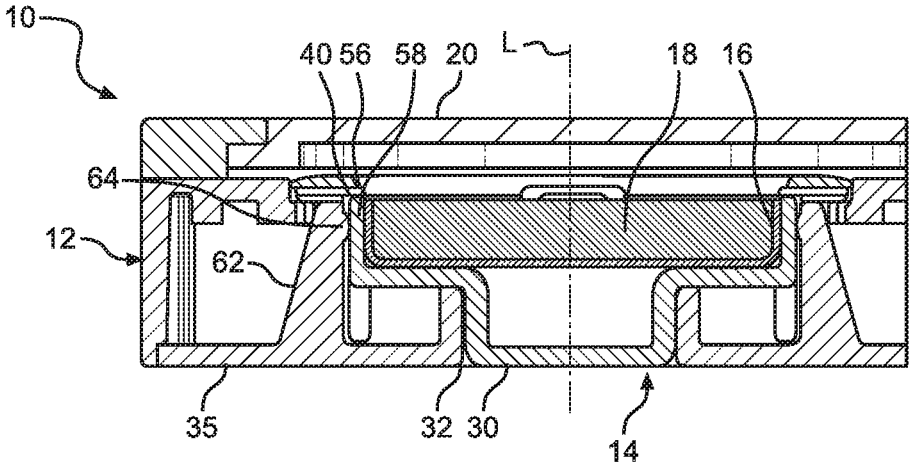
FIG. 26 is a sectioned view of the refillable cosmetic compact in an engaged configuration retaining a cosmetic pan.

As shown in FIGS. 25 and 26, the base structure 12 has a deflection member or plural deflection members 60 that project from the floor 35 of the structure 12. Each deflection member 60 has a deflection surface 64 positioned to engage a catch member 40. The deflection surface 64 here comprises an inward protuberance 64 with a converging surface that converges inwardly toward the longitudinal centerline L and thus toward the inner volume for retaining a product pan 16. One or more portions of each deflection surface 64 can slope inwardly or converge from the distal portion to the proximal portion thereof, or the deflection surface 64 can slope inwardly on a continuous or substantially continuous slope.

The deflection surfaces 64 are positioned to engage the outwardly facing surfaces of the catch members 40 as the product base insert 14 is moved from the released or disengaged position in relation to the base structure 12 as in FIG. 25 to an engaged or retention configuration in relation to the base structure 12 as in FIG. 26. The deflection surfaces 64 disengage the outwardly facing surfaces of the catch members 40 as the product base insert 14 is moved from the engaged position of FIG. 26 to the disengaged position of FIG. 25. For instance, the deflection surfaces 64 can slope from being disposed along a circular shape with a circumference greater than a circumference of a circular shape along which the outwardly facing surfaces of the catch members 40 are disposed when in a non-deflected configuration to being disposed along a circular shape with a circumference less than the circumference of the circular shape along which the outwardly facing surfaces of the catch members 40 are disposed when the catch members 40 are in a non-deflected configuration.

When the product base insert 14 is adjusted from the disengaged position to the engaged position, the catch members 40 are thus deflected inwardly from their non-deflected, disengaged position to an inwardly-deflected, engaged position. In the engaged position, the catch members 40 are operative to engage and retain a cosmetic pan 16. In this embodiment, the catch members 40 are inwardly deflected to be disposed along a shape, in this case a circular shape, wherein the retaining formations 56 of the catch members 40 mechanically engage the product pan 16. Here, the retaining formations 56 are induced to overlie an edge of the product pan 16 while the protuberances 58 engage the sidewall of the product pan 16. Again, other engagements, such as engagements of the catch members 40 into notches or other formations of the product pan 16, are possible within the scope of the invention.

With the cosmetic compact 10 so constructed and with the inner volume of the cosmetic compact 10 empty and with the product base insert 14 in the disengaged position of FIG. 25, a cosmetic product pan 16 retaining a volume of cosmetic 18 can be inserted into the reception volume within the product base insert 14 to have the bottom of the cosmetic product pan 16 disposed atop the floor 34 of the product base insert 14. The product base insert 14 and the retained cosmetic product pan 16 can then be pressed into engagement with the base structure 12. As the product base insert 14 moves into the engaged configuration with the base structure 12, the inwardly-facing deflection surfaces 64 engage the outer surfaces of the catch members 40. As the tips of the catch members 40 slide over sloped portions of the converging deflection surfaces 64, the catch members 40 are deflected inwardly toward the longitudinal centerline L of the compact 10 to cause the catch members 40 to converge on the cosmetic product pan 16. In this embodiment, the protuberances 58 of the catch members 40 are pressed into engagement with the sidewall of the product pan 16, and the retaining formations 56 are pressed into position overlying the edge of the product pan 16. With that, the cosmetic product pan 16 is locked into position within the cosmetic compact 10.

The cosmetic product pan 16 can be ejected or disengaged from the cosmetic compact 10 by a pressing on the release button 30 of the product base insert 14 that is exposed through the actuation opening 32 of the base structure 12. When the release button 30 is pressed with sufficient force, the product base insert 14 is driven from the engaged configuration of FIG. 26 to the disengaged configuration of FIG. 25. As the product base insert 14 moves into the disengaged configuration, the inwardly-facing deflection surfaces 64 disengage from the outer surfaces of the catch members 40. The catch members 40 deflect by their resilience outwardly away from the longitudinal centerline L of the compact 10 to cause the catch members 40 to diverge from the cosmetic product pan 16. The protuberances 58 of the catch members 40 move outwardly away from engagement with the sidewall of the product pan 16, and the retaining formations 56 move outwardly away from their position overlying the edge of the product pan 16. The cosmetic product pan 16 is thus released from its position within the cosmetic compact 10.

It will be understood that terms of orientation may be referenced herein merely provide a complete understanding of the disclosed cosmetic compact 10 and are not limiting of the invention. Other nomenclature and conventions may be used without limitation of the teachings herein. Furthermore, the various components disclosed herein are merely illustrative and are not limiting of the invention. For example, except as limited by the claims, each of the components discussed herein may include sub-components that collectively provide for the structure and function of the disclosed component. By way of example and not limitation, the base structure 12 and the product base insert 14 could either or both be formed unitarily as shown or with multiple sub-components. Additional components that provide additional functions, or enhancements to those introduced herein, may be included. For example, additional components and materials, combinations of components and/or materials, and/or omission of components or materials may be used to provide for added embodiments that are within the scope of the teachings herein. Modifications still within the scope of the invention as it is claimed may be designed according to the needs of a user, designer, manufacturer, or other interested party.

When introducing elements of the present invention or embodiments thereof, the articles "a," "an," and "the" are intended to mean that there are one or more of the elements. The terms "comprising," "including," and "having" are intended to be inclusive such that there may be additional elements other than the listed elements. As used herein, the term "example" or "exemplary" is not intended to imply a superlative example. Rather, "exemplary" refers to an embodiment that is one of many possible embodiments.

With certain details and embodiments of the present invention for a cosmetic compact 10 disclosed, it will be appreciated by one skilled in the art that numerous changes and additions could be made thereto without deviating from the spirit or scope of the invention. This is particularly true when one bears in mind that the presently preferred embodiments merely exemplify the broader invention revealed herein. Accordingly, it will be clear that those with major features of the invention in mind could craft embodiments that incorporate those major features while not incorporating all of the features included in the preferred embodiments.

Therefore, the following claims shall define the scope of protection to be afforded to the inventors. Those claims shall be deemed to include equivalent constructions insofar as they do not depart from the spirit and scope of the invention. It must be further noted that a plurality of the following claims may express, or be interpreted to express, certain elements as means for performing a specific function, at times without the recital of structure or material. As the law demands, any such claims shall be construed to cover not only the corresponding structure and material expressly described in this specification but also all legally cognizable equivalents thereof.

We claim as deserving the protection of Letters Patent:

1. A refillable cosmetic compact with an engaged configuration that permits a cosmetic product to be retained by the cosmetic compact and a disengaged configuration that permits the cosmetic product to be inserted into and removed from the cosmetic compact, the cosmetic compact comprising:

a product base insert with a floor and a sidewall wherein the floor and the sidewall define a cavity for receiving the cosmetic product;

a base structure with a floor, an outer wall structure, and an inner wall structure wherein the inner wall structure defines an actuation opening through the base structure and wherein the actuation opening is open to the product base insert;

wherein the product base insert is repositionable in relation to the base structure between an engaged configuration wherein the cosmetic product can be retained by the cosmetic compact and a disengaged configuration wherein the cosmetic product can be released from or inserted into the cosmetic compact; and wherein the base structure retains a plurality of resiliently deflectable catch members, wherein the product base insert has a corresponding plurality of apertures for receiving the catch members, wherein a converging surface is retained by the product base insert in relation to each aperture, wherein the each converging surface has a sloped portion disposed at a distal portion of the aperture, and wherein the converging surfaces are positioned to engage distal portions of the catch members as the product base insert is repositioned from the disengaged configuration to the engaged configuration to induce a deflection of the catch members laterally inwardly and to permit a deflection of the catch members laterally outwardly as the product base insert is repositioned from the engaged configuration to the disengaged configuration.

2. The refillable cosmetic compact of claim 1 wherein the refillable cosmetic compact has a longitudinal direction and wherein the catch members project from the floor of the base structure generally in the longitudinal direction.

3. The refillable cosmetic compact of claim 2 wherein the catch members retained by the base structure are disposed in opposition.

4. The refillable cosmetic compact of claim 1 wherein the converging surfaces slope from being spaced a distance greater than a distance between outwardly facing surfaces of the catch members when the catch members are in a non-deflected configuration to being spaced a distance less than the distance between the outwardly facing surfaces of the catch members when the catch members are in a non-deflected configuration.

5. The refillable cosmetic compact of claim 1 further comprising a retaining formation disposed at a distal end of each catch member.

6. The refillable cosmetic compact of claim 1 wherein the apertures in the product base insert have an L-shape with a base of the L-shape comprising a space within the floor of the product base insert and a bottom of the sidewall of the product base insert and an upstanding portion of the L-shape comprising an opening in the sidewall of the product base insert.

7. The refillable cosmetic compact of claim 1 wherein, when in a non-deflected configuration, the catch members have a lateral distance between the catch members sufficient to permit the insertion and removal of the cosmetic product.

8. The refillable cosmetic compact of claim 1 further comprising a latching mechanism for adjustably retaining the product base insert in the engaged configuration and in the disengaged configuration.

9. The refillable cosmetic compact of claim 8 wherein the latching mechanism comprises a snap-fit latching mechanism.

10. The refillable cosmetic compact of claim 9 wherein the latching mechanism is formed by at least one ridge retained by the product base insert and at least one ridge retained by the base structure disposed in opposition to the at least one ridge retained by the product base insert in an interference relationship.

11. The refillable cosmetic compact of claim 1 wherein the product base insert has a release button that is centrally disposed to project into the actuation opening in the base structure.

12. The refillable cosmetic compact of claim 11 wherein the release button has a lateral cross-sectional shape matching a lateral cross-sectional shape of the inner wall structure of the base structure that defines the actuation opening in the base structure.

13. The refillable cosmetic compact of claim 1 further comprising a cover with a closed configuration wherein the cavity is enclosed and an open configuration wherein the cavity is open.

14. The refillable cosmetic compact of claim 13 wherein the cover is coupled to the base structure by a hinge.

15. The refillable cosmetic compact of claim 1 further comprising a cosmetic product for being received in the inner volume of the product base insert.

16. The refillable cosmetic compact of claim 15 wherein the cosmetic product comprises a cosmetic product pan and a volume of cosmetic retained in the cosmetic product pan.

17. The refillable cosmetic compact of claim 1 wherein the refillable cosmetic compact is rectangular.

18. The refillable cosmetic compact of claim 17 wherein the refillable cosmetic compact is square.

19. The refillable cosmetic compact of claim 1 wherein the refillable cosmetic compact is rounded with a longitudinal centerline and wherein the converging surfaces have sloped portions that converge toward the longitudinal centerline.

20. The refillable cosmetic compact of claim 19 wherein the refillable cosmetic compact is circular.

21. The refillable cosmetic compact of claim 19 wherein the catch members are disposed along a rounded shape.

22. A refillable cosmetic compact with an engaged configuration that permits a cosmetic product to be retained by the cosmetic compact and a disengaged configuration that permits the cosmetic product to be inserted into and removed from the cosmetic compact, the cosmetic compact comprising:

a product base insert with a floor and a sidewall wherein the floor and the sidewall define a cavity for receiving the cosmetic product;

a base structure with a floor, an outer wall structure, and an inner wall structure wherein the inner wall structure defines an actuation opening through the base structure and wherein the actuation opening is open to the product base insert;

wherein the product base insert is repositionable in relation to the base structure between an engaged configuration wherein the cosmetic product can be retained by the cosmetic compact and a disengaged configuration wherein the cosmetic product can be released from or inserted into the cosmetic compact; and wherein the product base insert retains a plurality of resiliently deflectable catch members, wherein at least one deflection surface is retained by the base structure positioned to engage the catch members as the product base insert is repositioned from the disengaged configuration to the engaged configuration to induce a deflection of the catch members laterally inwardly and to permit a deflection of the catch members laterally outwardly as the product base insert is repositioned from the engaged configuration to the disengaged configuration.

23. The refillable cosmetic compact of claim 22 wherein the refillable cosmetic compact has a longitudinal direction and wherein the catch members project from the floor of the product base insert generally in the longitudinal direction.

24. The refillable cosmetic compact of claim 22 wherein the catch members retained by the product base insert are disposed in opposition.

25. The refillable cosmetic compact of claim 22 wherein opposed surfaces of the at least one deflection surface slope from being spaced a lateral distance greater than a lateral distance between outwardly facing surfaces of the catch members when the catch members are in a non-deflected configuration to being spaced a distance less than the distance between the outwardly facing surfaces of the catch members when the catch members are in a non-deflected configuration.

26. The refillable cosmetic compact of claim 22 further comprising a retaining formation disposed at a distal end of each catch member.

27. The refillable cosmetic compact of claim 1 wherein, when in a non-deflected configuration, the catch members have a lateral distance between the catch members sufficient to permit the insertion and removal of the cosmetic product.

28. A refillable cosmetic compact with an engaged configuration that permits a cosmetic product to be retained by the cosmetic compact and a disengaged configuration that permits the cosmetic product to be inserted into and removed from the cosmetic compact, the cosmetic compact comprising:

a base structure with a floor, an outer wall structure, and a plurality of resiliently deflectable catch members;

a product base insert with a floor and a sidewall wherein the floor and the sidewall of the product base insert define a cavity for receiving the cosmetic product;

wherein the product base insert is repositionable in relation to the base structure between an engaged configuration wherein the cosmetic product can be retained by the cosmetic compact and a disengaged configuration wherein the cosmetic product can be released from or inserted into the cosmetic compact;

a plurality of apertures in the product base insert for receiving the product pan catch members;

a converging surface retained by the product base insert in relation to each aperture wherein each converging surface has a sloped portion disposed at a distal portion of the aperture and wherein the converging surfaces are positioned to engage distal portions of the catch members as the product base insert is repositioned from the disengaged configuration to the engaged configuration to induce a deflection of the catch members laterally inwardly and to permit a deflection of the catch members laterally outwardly as the product base insert is repositioned from the engaged configuration to the disengaged configuration.

29. The refillable cosmetic compact of claim 28 wherein the base structure further comprises an inner wall structure wherein the inner wall structure defines an actuation opening through the base structure and wherein the actuation opening is open to the product base insert.

30. The refillable cosmetic compact of claim 29 wherein the product base insert has a release button that is centrally disposed to project into the actuation opening in the base structure.

31. The refillable cosmetic compact of claim 28 wherein the refillable cosmetic compact has a longitudinal direction and wherein the catch members project from the floor of the base structure generally in the longitudinal direction.

32. The refillable cosmetic compact of claim 31 wherein the product pan catch members retained by the base structure are disposed in opposition.

33. The refillable cosmetic compact of claim 28 wherein the converging surfaces slope from being spaced a distance greater than a distance between outwardly facing surfaces of the catch members when the catch members are in a non-deflected configuration to being spaced a distance less than the distance between the outwardly facing surfaces of the catch members when the catch members are in a non-deflected configuration.

34. The refillable cosmetic compact of claim 28 further comprising a latching mechanism for adjustably retaining the product base insert in the engaged configuration and in the disengaged configuration.

35. The refillable cosmetic compact of claim 34 wherein the latching mechanism comprises a snap-fit latching mechanism formed by at least one ridge retained by the product base insert and at least one ridge retained by the base structure disposed in opposition to the at least one ridge retained by the product base insert in an interference relationship.

36. A refillable cosmetic compact with an engaged configuration that permits a cosmetic product to be retained by the cosmetic compact and a disengaged configuration that permits the cosmetic product to be inserted into and removed from the cosmetic compact, the cosmetic compact comprising:

a base structure with a floor and an outer wall structure;

a product base insert with a floor, a sidewall, and a plurality of resiliently deflectable catch members wherein the floor and the sidewall of the product base insert define a cavity for receiving the cosmetic product;

wherein the product base insert is repositionable in relation to the base structure between an engaged configuration wherein the cosmetic product can be retained by the cosmetic compact and a disengaged configuration wherein the cosmetic product can be released from or inserted into the cosmetic compact;

at least one deflection surface retained by the base structure, the at least one deflection surface positioned to engage each catch member as the product base insert is repositioned from the disengaged configuration to the engaged configuration to induce a deflection of the catch members laterally inwardly and to permit a deflection of the catch members laterally outwardly as the product base insert is repositioned from the engaged configuration to the disengaged configuration.

37. The refillable cosmetic compact of claim 36 wherein the base structure further comprises an inner wall structure wherein the inner wall structure defines an actuation opening through the base structure and wherein the actuation opening is open to the product base insert.

38. The refillable cosmetic compact of claim 37 wherein the product base insert has a release button that is centrally disposed to project into the actuation opening in the base structure.

39. The refillable cosmetic compact of claim 36 wherein the refillable cosmetic compact has a longitudinal direction and wherein the catch members project from the floor of the product base insert generally in the longitudinal direction.

40. The refillable cosmetic compact of claim 39 wherein the product pan catch members retained by the product base insert are disposed in opposition.

41. The refillable cosmetic compact of claim 36 wherein the at least one deflection surface slopes from being spaced a distance greater than a distance between outwardly facing surfaces of the catch members when the catch members are in a non-deflected configuration to being spaced a distance less than the distance between the outwardly facing surfaces of the catch members when the catch members are in a non-deflected configuration.

* * * * *